US010544925B2

(12) United States Patent
Pratt et al.

(10) Patent No.: US 10,544,925 B2
(45) Date of Patent: Jan. 28, 2020

(54) MOUNTING SYSTEM FOR RETROFIT LIGHT INSTALLATION INTO EXISTING LIGHT FIXTURES

(75) Inventors: S. Scott Pratt, Cary, NC (US); Patrick O'Flaherty, Morrisville, NC (US); James Michael Lay, Cary, NC (US); Nathan Snell, Raleigh, NC (US)

(73) Assignee: Ideal Industries Lighting LLC, Sycamore, IL (US)

( * ) Notice: Subject to any disclaimer, the term of this patent is extended or adjusted under 35 U.S.C. 154(b) by 0 days.

(21) Appl. No.: 13/464,745

(22) Filed: May 4, 2012

(65) Prior Publication Data

US 2013/0176716 A1 Jul. 11, 2013

Related U.S. Application Data

(60) Provisional application No. 61/584,092, filed on Jan. 6, 2012.

(51) Int. Cl.

| | |
|---|---|
| ***F21V 21/04*** | (2006.01) |
| ***F21S 8/02*** | (2006.01) |
| ***F21V 23/00*** | (2015.01) |

(52) U.S. Cl.

CPC ..... *F21V 21/049* (2013.01); *F21S 8/02* (2013.01); *F21V 23/009* (2013.01); *Y10T 29/49117* (2015.01)

(58) Field of Classification Search

CPC ..... F21S 8/02; F21S 8/026; Y10T 29/49117; F21Y 2101/02; F21K 9/27; F21K 9/272;

(Continued)

(56) References Cited

U.S. PATENT DOCUMENTS

| | | | | |
|---|---|---|---|---|
| D85,382 | S | 10/1931 | Guth | D26/24 |
| 2,356,654 | A | 8/1944 | Cullman | 200/84 C |

(Continued)

FOREIGN PATENT DOCUMENTS

| | | |
|---|---|---|
| CN | 1762061 | 4/2006 |
| CN | 1934389 | 3/2007 |

(Continued)

OTHER PUBLICATIONS

International Search Report and Written Opinion for PCT Application No. PCT/US2011/062396, dated Jul. 13, 2012.

(Continued)

*Primary Examiner* — Sean P Gramling
(74) *Attorney, Agent, or Firm* — Myers Bigel, P.A.

(57) ABSTRACT

Lighting retrofit systems and methods are disclosed that can be used with different light fixtures, but that are particularly adapted for use with retrofitting troffer-style fixtures with LED based light engines. The retrofit systems being assembled without disturbing the lighting or troffer pan or housing ("troffer pan") for the lighting system being retrofitted. Some of these embodiments can comprise a mounting fixture or frame that can be mounted in an opening in a ceiling grid, and held in place between the grid and the troffer pan edge. The fixture or frame can comprise an opening for a light engine, with the engine being quickly and easily connected to electrical power in the troffer pan and then mountable within the frame opening. These embodiments can allow for the quick and easy construction of the retrofit system without the need for adhesives and fasteners such brackets and screws.

45 Claims, 9 Drawing Sheets

(58) Field of Classification Search
CPC ..... F21K 9/275; F21K 9/278; F21V 23/02; F21V 23/023; F21V 23/026; F21V 23/003; F21V 23/006; F21V 23/008; F21V 23/009; F21V 21/048–049; F21V 23/007–009
USPC ..... 362/217.11–217.17
See application file for complete search history.

(56) References Cited

U.S. PATENT DOCUMENTS 3,381,124 A 4/1968 Eisenberg ..... 362/354
3,743,826 A 7/1973 Halfaker
3,790,774 A * 2/1974 Miller ..... F21V 17/107 362/220
4,939,627 A 7/1990 Herst et al. ..... 362/299
5,025,356 A 6/1991 Gawad ..... 362/221
5,526,190 A 6/1996 Hubble, III ..... 347/102
5,823,663 A 10/1998 Bell et al. ..... 362/362
D407,473 S 3/1999 Wimbock ..... D23/328
6,079,851 A * 6/2000 Altman ..... F21S 8/02 362/217.05
6,102,550 A * 8/2000 Edwards, Jr. ..... F21S 8/02 362/217.05
6,149,283 A 11/2000 Conway et al. ..... 362/236
6,155,699 A 12/2000 Miller et al. ..... 362/293
6,210,025 B1 4/2001 Schmidt et al. ..... 362/362
6,234,643 B1 5/2001 Lichon, Jr. ..... 362/147
6,402,347 B1 6/2002 Maas et al. ..... 362/294
6,443,598 B1 9/2002 Morgan ..... 362/342
6,523,974 B2 2/2003 Engel ..... 362/224
6,578,979 B2 6/2003 Truttmann-Battig ..... 362/92
6,598,998 B2 7/2003 West ..... 257/E33.073
D496,121 S 9/2004 Santoro ..... D26/74
6,871,983 B2 3/2005 Jacob et al. ..... 362/364
6,948,838 B2 9/2005 Kunstler ..... 362/237
6,948,840 B2 9/2005 Grenda et al. ..... 362/555
6,951,415 B2 10/2005 Amano ..... 362/297
7,021,797 B2 4/2006 Minano et al. ..... 362/355
7,049,761 B2 5/2006 Timmermans et al. ..... 315/246
7,063,449 B2 6/2006 Ward ..... 345/102
7,111,969 B2 9/2006 Bottesch ..... 362/299
7,175,296 B2 2/2007 Cok ..... 362/147
7,213,940 B1 5/2007 Van de Ven et al. ..... 362/231
7,217,004 B2 5/2007 Park ..... 362/240
7,237,924 B2 7/2007 Martineau et al. ..... 362/231
D556,358 S 11/2007 Santoro ..... D26/74
7,338,182 B1 3/2008 Hastings et al. ..... 362/150
7,341,358 B2 3/2008 Hsieh ..... 362/97.1
7,510,299 B2 3/2009 Timmermans et al. ..... 362/225
7,520,636 B2 4/2009 Van Der Poel ..... 362/290
D593,246 S 5/2009 Fowler et al. ..... D26/76
7,559,672 B1 7/2009 Parkyn et al. ..... 362/244
7,594,736 B1 9/2009 Kassay et al. ..... 362/223
D604,446 S 11/2009 Fowler et al. ..... D26/76
7,614,767 B2 11/2009 Zulim
7,618,157 B1 11/2009 Galvez et al. ..... 362/294
7,618,160 B2 11/2009 Chinniah et al. ..... 362/326
D608,932 S 1/2010 Castelli ..... D26/76
7,654,688 B2 2/2010 Li
7,654,702 B1 2/2010 Ding et al. ..... 362/294
7,661,844 B2 2/2010 Sekiguchi et al. ..... 362/249
D611,183 S 3/2010 Duarte ..... D26/76
7,674,005 B2 3/2010 Chung et al. ..... 362/223
7,686,470 B2 3/2010 Chiang ..... 362/147
7,686,484 B2 * 3/2010 Heiking et al. ..... 362/375
7,695,157 B2 * 4/2010 Yaphe ..... F21V 15/013 362/147
7,712,918 B2 5/2010 Siemiet et al. ..... 362/241
7,722,220 B2 5/2010 Van de Ven ..... 362/294
7,722,227 B2 5/2010 Zhang et al. ..... 362/364
D617,487 S 6/2010 Fowler et al. ..... D26/76
7,768,192 B2 8/2010 Van de Ven et al. ..... 313/503
7,815,338 B2 10/2010 Siemiet et al. ..... 362/218
7,824,056 B2 11/2010 Madireddi et al. ..... 362/125
7,828,468 B2 11/2010 Mayfield et al. ..... 362/342
7,868,484 B2 1/2011 Groff et al. ..... 362/375
D633,247 S 2/2011 Kong et al. ..... D26/88
7,922,354 B2 4/2011 Everhart ..... 362/235
7,926,982 B2 4/2011 Liu ..... 362/294
7,959,332 B2 6/2011 Tickner
7,988,321 B2 8/2011 Wung et al. ..... 362/218
7,988,335 B2 8/2011 Liu et al. ..... 362/294
7,991,257 B1 8/2011 Coleman
7,993,034 B2 8/2011 Wegner ..... 362/296.05
7,997,762 B2 8/2011 Wang et al. ..... 362/249
8,038,314 B2 10/2011 Ladewig
8,038,321 B1 10/2011 Franck et al. ..... 362/249.02
8,070,326 B2 12/2011 Lee ..... 362/307
D653,376 S 1/2012 Kong et al. ..... D26/76
8,092,043 B2 1/2012 Lin et al. ..... 362/249.02
8,092,049 B2 1/2012 Kinnune et al. ..... 362/294
8,096,671 B1 1/2012 Cronk ..... 362/147
D657,488 S 4/2012 Lown et al. ..... D26/120
8,162,504 B2 4/2012 Zhang et al. ..... 362/217
8,186,855 B2 5/2012 Wassel et al. ..... 362/373
8,197,086 B2 6/2012 Watanabe et al. ..... 362/218
8,201,968 B2 6/2012 Maxik et al.
8,215,799 B2 7/2012 Vanden Eynden et al. ..... 362/294
8,246,219 B2 8/2012 Teng ..... 362/217.02
8,256,927 B2 9/2012 Hu ..... 362/218
8,287,160 B2 10/2012 Shen
D670,849 S 11/2012 Lay et al. ..... D26/74
8,317,354 B2 11/2012 Gassner et al. ..... 362/147
D676,848 S 4/2013 Pickard et al. ..... D26/74
8,410,514 B2 4/2013 Kim ..... 257/99
D684,291 S 6/2013 Goelz et al. ..... D26/74
8,480,252 B2 7/2013 Bertram et al. ..... 362/243
8,506,135 B1 8/2013 Oster ..... 362/373
8,523,383 B1 * 9/2013 Grigore ..... F21S 8/026 362/217.13
8,556,452 B2 10/2013 Simon ..... 362/217.07
8,591,058 B2 11/2013 Concepcion ..... 362/231
8,591,071 B2 11/2013 Hochstein ..... 362/294
8,602,601 B2 12/2013 Khazi
8,616,723 B2 12/2013 Zhang ..... 362/218
D698,975 S 2/2014 Blessitt et al. ..... D26/74
8,641,243 B1 2/2014 Rashidi ..... 362/373
D701,988 S 4/2014 Clements ..... D26/74
8,696,154 B2 4/2014 Hutchens ..... 362/217.05
8,702,264 B1 4/2014 Rashidi ..... 362/147
8,764,244 B2 7/2014 Jeon ..... 362/218
D714,988 S 10/2014 Park et al. ..... D26/74
D721,198 S 1/2015 Glasbrenner ..... D26/76
9,010,956 B1 4/2015 Davis
9,052,075 B2 6/2015 Demuynck et al.
2003/0063476 A1 4/2003 English et al.
2004/0001344 A1 1/2004 Hecht ..... 362/555
2004/0085779 A1 5/2004 Pond et al. ..... 362/516
2004/0100796 A1 5/2004 Ward
2004/0240230 A1 12/2004 Kitajima ..... 362/558
2005/0180135 A1 8/2005 Mayer ..... 362/240
2005/0264716 A1 12/2005 Kim et al.
2005/0281023 A1 12/2005 Gould
2006/0221611 A1 10/2006 No ..... 362/247
2006/0245208 A1 11/2006 Sakamoto
2006/0262521 A1 11/2006 Piepgras et al. ..... 362/149
2006/0279671 A1 12/2006 Han
2006/0291206 A1 12/2006 Angelini et al. ..... 352/244
2007/0070625 A1 3/2007 Bang ..... 362/240
2007/0109779 A1 5/2007 Sekiguchi et al.
2007/0115670 A1 5/2007 Roberts et al.
2007/0115671 A1 5/2007 Roberts et al.
2007/0211457 A1 9/2007 Mayfield et al. ..... 362/223
2007/0253205 A1 * 11/2007 Welker ..... 362/373
2007/0279910 A1 12/2007 Lin
2007/0297181 A1 12/2007 Mayfield et al. ..... 362/342
2008/0019147 A1 1/2008 Erchak ..... 362/607
2008/0037284 A1 2/2008 Rudisill ..... 362/629
2008/0049422 A1 2/2008 Trenchard et al. ..... 362/238
2008/0232093 A1 9/2008 Kim
2008/0278943 A1 11/2008 Van Der Poel ..... 362/240
2008/0303977 A1 12/2008 Sekiguchi

(56) References Cited

U.S. PATENT DOCUMENTS

| | | | | |
|---|---|---|---|---|
| 2009/0034247 | A1 | 2/2009 | Boyer | 362/225 |
| 2009/0073693 | A1 | 3/2009 | Nall | 362/249.02 |
| 2009/0161356 | A1 | 6/2009 | Negley et al. | 362/231 |
| 2009/0168439 | A1 | 7/2009 | Chiang | 362/404 |
| 2009/0196024 | A1 | 8/2009 | Heiking et al. | 362/150 |
| 2009/0225543 | A1 | 9/2009 | Jacobson et al. | |
| 2009/0237956 | A1 | 9/2009 | Kim | |
| 2009/0237958 | A1 | 9/2009 | Kim | |
| 2009/0262543 | A1 | 10/2009 | Ho | 362/373 |
| 2009/0296388 | A1 | 12/2009 | Wu et al. | 362/235 |
| 2009/0310354 | A1 | 12/2009 | Zampini et al. | 362/235 |
| 2009/0323334 | A1 | 12/2009 | Roberts et al. | |
| 2010/0039579 | A1 | 2/2010 | Park | |
| 2010/0061108 | A1 | 3/2010 | Zhang et al. | 362/364 |
| 2010/0097794 | A1 | 4/2010 | Teng et al. | 362/231 |
| 2010/0103678 | A1 | 4/2010 | Van de Ven et al. | 362/294 |
| 2010/0110679 | A1 | 5/2010 | Teng et al. | |
| 2010/0142202 | A1 | 6/2010 | Sugishita | |
| 2010/0172133 | A1 | 7/2010 | Lie | 362/235 |
| 2010/0177514 | A1 | 7/2010 | Liu | |
| 2010/0177532 | A1 | 7/2010 | Simon et al. | |
| 2010/0188609 | A1 | 7/2010 | Matsuki et al. | |
| 2010/0253591 | A1 | 10/2010 | Hwu et al. | 345/1.3 |
| 2010/0254128 | A1 | 10/2010 | Pickard et al. | 362/231 |
| 2010/0254145 | A1 | 10/2010 | Yamaguchi | |
| 2010/0254146 | A1 | 10/2010 | McCanless | |
| 2010/0270903 | A1 | 10/2010 | Jao et al. | 313/46 |
| 2010/0271843 | A1 | 10/2010 | Holten et al. | 362/609 |
| 2010/0277905 | A1 | 11/2010 | Janik et al. | 362/235 |
| 2010/0277934 | A1 | 11/2010 | Oquendo, Jr. | 362/433 |
| 2010/0295468 | A1 | 11/2010 | Pedersen et al. | 315/294 |
| 2010/0302778 | A1 | 12/2010 | Dabiet | |
| 2010/0327768 | A1 | 12/2010 | Kong et al. | 315/294 |
| 2011/0032714 | A1 | 2/2011 | Chang | 362/373 |
| 2011/0043132 | A1 | 2/2011 | Kim et al. | |
| 2011/0090671 | A1 | 4/2011 | Bertram et al. | 362/84 |
| 2011/0141722 | A1 | 6/2011 | Acampora et al. | 362/218 |
| 2011/0141734 | A1 | 6/2011 | Li | 362/235 |
| 2011/0156584 | A1 | 6/2011 | Kim | 315/32 |
| 2011/0164417 | A1 | 7/2011 | Huang | 362/235 |
| 2011/0175533 | A1 | 7/2011 | Homan | 315/130 |
| 2011/0199005 | A1 | 8/2011 | Bretschneider et al. | |
| 2011/0199769 | A1 | 8/2011 | Bretschneider et al. | |
| 2011/0222291 | A1 | 9/2011 | Peng | |
| 2011/0246146 | A1 | 10/2011 | Kauffman et al. | 703/2 |
| 2011/0255292 | A1 | 10/2011 | Shen | 362/311 |
| 2011/0267810 | A1 | 11/2011 | Higman et al. | 362/218 |
| 2011/0267823 | A1 | 11/2011 | Angelini et al. | 362/277 |
| 2011/0286225 | A1* | 11/2011 | Konishi | F21V 19/0085 362/398 |
| 2011/0305024 | A1 | 12/2011 | Chang | 362/294 |
| 2012/0033420 | A1 | 2/2012 | Kim et al. | 362/235 |
| 2012/0038289 | A1 | 2/2012 | Jee et al. | 315/291 |
| 2012/0051041 | A1 | 3/2012 | Edmond et al. | 362/231 |
| 2012/0120658 | A1 | 5/2012 | Wilk | |
| 2012/0127714 | A1 | 5/2012 | Rehn | |
| 2012/0134146 | A1 | 5/2012 | Smith | 362/225 |
| 2012/0140442 | A1 | 6/2012 | Woo | 362/95 |
| 2012/0140461 | A1 | 6/2012 | Huang et al. | |
| 2012/0206926 | A9 | 8/2012 | Chou | |
| 2012/0320576 | A1* | 12/2012 | Wald | F21V 23/026 362/217.09 |
| 2013/0235568 | A1 | 9/2013 | Green et al. | 362/218 |
| 2013/0242550 | A1 | 9/2013 | Suen | |
| 2013/0258652 | A1 | 10/2013 | Hsieh | 362/225 |
| 2014/0265930 | A1 | 9/2014 | Harris | 315/307 |
| 2015/0016100 | A1 | 1/2015 | Ishii | 362/223 |

FOREIGN PATENT DOCUMENTS

| | | | |
|---|---|---|---|
| CN | 1963289 | A | 5/2007 |
| CN | 101188261 | | 5/2008 |
| CN | 101660715 | | 3/2010 |
| CN | 101776254 | | 7/2010 |
| CN | 101776254 | A | 7/2010 |
| CN | 101790660 | | 7/2010 |
| CN | 101790660 | A | 7/2010 |
| CN | 102072443 | | 5/2011 |
| CN | 202580962 | | 12/2012 |
| DE | 102007030186 | | 1/2009 |
| DE | 102007030186 | A1 | 1/2009 |
| DE | 202010001832 | | 7/2010 |
| EP | 1298383 | | 4/2003 |
| EP | 1298383 | A2 | 4/2003 |
| EP | 1357335 | A2 | 10/2003 |
| EP | 1653254 | | 3/2006 |
| EP | 1737051 | | 12/2006 |
| EP | 1047762 | | 10/2007 |
| EP | 1847762 | A2 | 10/2007 |
| EP | 1860467 | | 11/2007 |
| EP | 2287520 | A2 | 2/2011 |
| EP | 2290690 | A2 | 3/2011 |
| EP | 2636945 | A2 | 9/2013 |
| GB | 774198 | | 5/1957 |
| JP | 1069809 | | 3/1998 |
| JP | 2002244027 | | 11/2002 |
| JP | U3097327 | | 8/2003 |
| JP | 2004140327 | | 5/2004 |
| JP | 2004345615 | | 12/2004 |
| JP | 2004345615 | A | 12/2004 |
| JP | 2006173624 | | 6/2006 |
| JP | 2008147044 | | 6/2008 |
| JP | 3151501 | U | 6/2009 |
| JP | 2009295577 | | 12/2009 |
| JP | 2010103687 | | 5/2010 |
| JP | 2011018571 | | 8/2011 |
| JP | 2011018572 | | 8/2011 |
| TW | 200524186 | | 7/2005 |
| TW | 200524186 | A | 7/2005 |
| TW | 200914759 | A | 4/2009 |
| TW | 201018826 | | 5/2010 |
| TW | 201018826 | A | 5/2010 |
| WO | WO 03102467 | | 12/2003 |
| WO | WO 2009030233 | | 3/2009 |
| WO | WO 2009140761 | A1 | 11/2009 |
| WO | WO 2009157999 | | 12/2009 |
| WO | WO 2009157999 | A | 12/2009 |
| WO | WO 2009157999 | A1 | 12/2009 |
| WO | WO 2010024583 | | 3/2010 |
| WO | WO 2010024583 | A2 | 3/2010 |
| WO | WO 2010042216 | | 4/2010 |
| WO | WO 2010042216 | A2 | 4/2010 |
| WO | WO 2011074424 | A1 | 6/2011 |
| WO | WO 2011096098 | A1 | 8/2011 |
| WO | WO 2011098191 | | 8/2011 |
| WO | WO 2011118991 | A2 | 9/2011 |
| WO | WO 2011140353 | A2 | 11/2011 |
| WO | WO 03102467 | | 12/2013 |

OTHER PUBLICATIONS

Notice to Submit a Response from Korean Patent Application No. 30-2011-0036115. dated Dec. 12, 2012.

Notice to Submit a Response from Korean Patent Application No. 30-2011-0038116. dated Dec. 12, 2012.

Search Report and Written Opinion from PCT Patent Appl. No. PCT/US2012/047084, dated Feb. 27, 2013.

Search Report and Written Opinion from PCT Patent Appl. No. PCT/US2012/071800, dated Mar. 25, 2013.

International Search Report and Written Opinion from PCT Application No. PCT/US2013/021053, dated Apr. 17, 2013.

Office Action from Japanese Design Patent Application No. 2011-18570.

Reason for Rejection from Japanese Design Patent Application No. 2011-18571.

Reason for Rejection from Japanese Design Patent Application No. 2011-18572.

International Search Report and Written Opinion for Patent Application No. PCT/US2011/001517, dated Feb. 27, 2012.

U.S. Appl. No. 12/873,303, filed Aug. 31, 2010 to Edmond, et al.

U.S. Appl. No. 12/961,385, filed Dec. 6, 2010 to Pickard, et al.

(56) References Cited

OTHER PUBLICATIONS

Cree's XLamp XP-E LED's, data sheet, pp. 1-16.
Cree's XLamp XP-G LED's, data sheet, pp. 1-12.
International Search Report and Written Opinion from PCT/US2013/049225, dated Oct. 24, 2013.
Final Rejection issued in Korean Design Appl. No. 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl No. PCT/US2013/035668, dated Jul. 12, 2013.
Office Action from U.S. Appl. No. 29/387,171, dated May 2, 2012.
Response to OA from U.S. Appl. No. 29/387,171, filed Aug. 2, 2012.
Office Action from U.S. Appl. No. 12/961,385, dated Apr. 26, 2013.
Response to OA from U.S. Appl. No. 12/961,385, filed Jul. 24, 2013.
Office Action from U.S. Appl. No. 29/368,970, dated Jun. 19, 2012.
Office Action from U.S. Appl. No. 29/368,970, dated Aug. 24, 2012.
Response to OA from U.S. Appl. No. 29/366,970, filed Nov. 26, 2012.
Preliminary Report and Written Opinion from PCT appl. No. PCT/US2012/047084, dated Feb. 6, 2014.
Office Action from U.S. Appl. No. 13/429,080, dated Apr. 18, 2014.
Office Action from U.S. Appl. No. 12/961,385, dated Mar. 11, 2014.
International Search Report and Written Opinion from Appl. No. PCT/CN2013/072772, dated Dec. 19, 2013.
International Preliminary Report on Patontabiliby from PCT/US2012/071800 dated Jul. 10, 2014.
Office Action from U.S. Appl. No. 13/189,535, dated Jun. 20, 2014.
Office Action from U.S. Appl. No. 13/453,924, dated Jun. 25, 2014.
Office Action from U.S. Appl. No. 13/443,630, dated Jul. 1, 2014.
Communication from European Patent Appl. No. 13701525.1-1757, dated Sep. 26, 2014.
Reasons for Rejection from Japanese Patent Appl. No. 2013-543207, dated May 20, 2014.
First Office Action from Chinese Patent Appl. No. 2011800529984, dated May 4, 2014.
Office Action from U.S. Appl. No. 13/544,662, dated May 5, 2014.
Office Action from U.S. Appl. No. 13/844,431, dated May 15, 2014.
Office Action from U.S. Appl. No. 13/341,741, dated Jun. 6, 2014.
Office Action from U.S. Appl. No. 13/442,746, dated Sep. 15, 2014.
Office Action from U.S. Appl. No. 13/429,080, dated Sep. 16, 2014.
Office Action from U.S. Appl. No. 13/844,431, dated Oct. 10, 2014.
Office Action from U.S. Appl. No. 13/443,630, dated Oct. 10, 2014.
Office Action from U.S. Appl. No. 13/368,217, dated Oct. 22, 2014.
Office Action from U.S. Appl. No. 12/961,385, dated Nov. 6, 2014.
Office Action from U.S. Appl. No. 13/453,924, dated Nov. 7, 2014.
Decision of Rejection from Japanese Appl. No. 2013-543207, dated Nov. 25, 2014.
Office Action from Mexican Appl. No. 100881, dated Nov. 28, 2014.
Grant Notice from European Appl. No. 13701525.1-1757, dated Nov. 24, 2014.
Preliminary Report on Patentability from PCT/US2013/035668, dated Oct. 14, 2014.
First Official Action from European Patent Appl. No. 12 743 003.1-1757, dated Jan. 16, 2015.
Second Office Action and Search Report from Chinese Appl. No. 2011800529984, dated Dec. 26, 2014.
Grant Notice from European Appl. No. 13701525.1, dated Nov. 19, 2014.
International Report and Written Opinion from PCT/US2013/049225, dated Jan. 22, 2015.
Office Action from U.S. Appl. No. 13/828,348, dated Nov. 20, 2014.
Office Action from U.S. Appl. No. 12/873,303, dated Nov. 28, 2014.
Office Action from U.S. Appl. No. 13/341,741, dated Dec. 24, 2014.
Office Action from U.S. Appl. No. 13/189,535, dated Jan. 13, 2015.
Notice of Completion of Pretrial Re-examination from Japanese Patent appl. No. 2013-543207. dated Jun. 30, 2015.
Pretrial Report from Japanese Appl. No. 2013-543207, dated Jun. 19, 2015.
Decision of Rejection from Chinese Patent Appl. No. 2011800529984, dated Jul. 16, 2015.
Office Action from U.S. Appl. No. 12/873,303, dated Jun. 22, 2015.
Response to OA from U.S. Appl. No. 12/873,303, filed Aug. 21, 2015.
Office Action from U.S. Appl. No. 13/341,741, dated Jun. 22, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/189,535, dated Jul. 14, 2015.
Office Action from U.S. Appl. No. 13/453,924, dated Jul. 21, 2015.
Office Action from U.S. Appl. No. 13/442,746, dated Jul. 27, 2015.
Office Action from U.S. Appl. No. 14/020,757, dated Aug. 3, 2015.
Office Action from U.S. Appl. No. 13/787,727, dated Jan. 29, 2015.
Office Action from U.S. Appl. No. 13/429,080, dated Feb. 18, 2015.
Office Action from U.S. Appl. No. 13/453,924, dated Mar. 10, 2015.
First Office Action from Chinese Patent Appl. No. 2012800369142, dated Mar. 26, 2015.
Office Action from U.S. Appl. No. 13/442,746, dated Apr. 28, 2015.
Office Action from U.S. Appl. No. 13/368,217, dated May 13, 2015.
Office Action from U.S. Appl. No. 13/828,348, dated May 27, 2015.
Office Action from U.S. Appl. No. 12/961,385, dated Nov. 27, 2015.
Office Action from U.S. Appl. No. 13/828,348, dated Nov. 4, 2015.
Office Action from U.S. Appl. No. 14/020,757, dated Nov. 24, 2014.
First Office Action from Chinese Patent Appl. No. 2011800588770, dated Sep. 25, 2015.
Office Action from U.S. Appl. No. 13/429,080, dated Sep. 1, 2015.
Office Action from U.S. Appl. No. 14/716,480, dated Sep. 24, 2015.
Office Action from U.S. Appl. No. 14/170,627, dated Oct. 5, 2015.
Office Action from U.S. Appl. No. 13/368,217, dated Oct. 8, 2015.
Office Action from U.S. Appl. No. 29/466,391, dated Oct. 14, 2015.
Office Action from U.S. Appl. No. 14/716,480, dated Mar. 3, 2016.
Office Action from U.S. Appl. No. 13/368,217, dated Mar. 4, 2016.
Office Action from U.S. Appl. No. 13/189,535, dated Mar. 18, 2016.
Office Action from U.S. Appl. No. 14/020,757, dated Apr. 7, 2016.
Office Action from U.S. Appl. No. 29/466,391, dated May 10, 2016.
Second Office Action for Application No. 2011800588770, dated Mar. 29, 2016.
Examination Report from Taiwanese Patent Appl. No. 100131021, dated Jan. 5, 2016.
Examination from European Patent Appl. No. 12743003.1-1757, dated Jan. 8, 2016.
Notice of Reasons for Rejection from Japanese Patent Appl. No. 2013-543207, dated Feb. 2, 2016.
Examination from European Patent Appl. No. 13 701 525.1-1757, dated Feb. 3, 2016.
Office Action from U.S. Appl. No. 13/189,535, dated Jan. 6, 2016.
Office Action from U.S. Appl. No. 13/341,741, dated Jan. 8, 2016,
Office Action from U.S. Appl. No. 13/873,303, dated Feb. 2, 2016.
Notification of Reexamination for Chinese Application No. 2011800529984, dated Oct. 10, 2016.
Office Action for U.S. Appl. No. 13/828,348, dated Oct. 17, 2016.
Office Action for European Application No. 11754767.9, dated Oct. 31, 2016.
Office Action for U.S. Appl. No. 12/873,303, dated Nov. 25, 2016.
Notice of Allowance for Taiwan Application No. 100131021, dated Nov. 28, 2016.
Office Action for U.S. Appl. No. 13/368,217, dated Jan. 3, 2017.
Office Action for U.S. Appl. No. 14/020,757, dated Jul. 19, 2016.
Examination Report from Taiwan Application No. 100131021, dated Jul. 21, 2016.
Office Action for U.S. Appl. No. 14/716,480, dated Aug. 26, 2016.
European Summons for Oral Proceedings for Application No. 12743003.1; Dated Sep. 2, 2016.
Office Action for U.S. Appl. No. 14/170,627, dated Jun. 16, 2017.
Office Action for U.S. Appl. No. 14/716,480, dated Jul. 5, 2017.
Office Action for U.S. Appl. No. 12/873,303, dated Aug. 9, 2017.
Office Action for U.S. Appl. No. 13/828,348, dated Sep. 1, 2017.
Office Action for U.S. Appl. No. 14/716,480, dated Feb. 8, 2017.

(56) References Cited

OTHER PUBLICATIONS

Foreign Office Action for Japanese Application No. 2013-543207, dated Feb. 14, 2017.
Office Action for U.S. Appl. No. 14/225,327, dated Mar. 14, 2017.
European Notice of Allowance for Application No. 12743003.1, dated Mar. 17, 2017.
Office Action for U.S. Appl. No. 13/189,535, dated Mar. 23, 2017.
Foreign Office Action for Chinese Application No. 2011800529984, dated Apr. 5, 2017.
Office Action for U.S. Appl. No. 14/721,806, dated Apr. 21, 2017.
Office Action for U.S. Appl. No. 13/443,630, dated May 18, 2017.
Office Action for U.S. Appl. No. 14/716,480, dated Jan. 17, 2018.
Office Action for U.S. Appl.No. 14/225,327, dated Oct. 2, 2017.
Office Action for U.S. Appl. No. 13/189,535, dated Oct. 30, 2017.
Office Action for U.S. Appl. No. 14/721,806, dated Nov. 1, 2017.
Office Action for U.S. Appl. No. 14/170,627, dated Nov. 29, 2017.
Office Action for U.S. Appl. No. 14/170,627, dated Jun. 4, 2018.
Office Action for U.S. Appl. No. 12/873,303, dated Jun. 19, 2018.
Office Action for U.S. Appl. No. 13/828,348, dated Jun. 26, 2018.
Office Action for U.S. Appl. No. 14/716,480, dated Jul. 13, 2018.
Office Action for U.S. Appl. No. 14/721,806, dated Jul. 27, 2018.
Office Action for U.S. Appl. No. 13/189,535, dated Apr. 5, 2018.
Office Action for U.S. Appl. No. 14/225,327, dated Apr. 19, 2018.
Foreign Office Action for European Application No. 11754767.9, dated May 7, 2018.
Office Action for U.S. Appl. No. 13/828,348, dated Jun. 2, 2016.
Notice of Reason for Rejection for Japanese Appl. No. 2013-543207, dated May 24, 2016.
International Preliminary Report on Patentability and Written Opinion from PCT/US2013/021053, dated Aug. 21, 2014.
Office Action from U.S. Appl. No. 13/453,924, dated Feb. 19, 2014.
Office Action from U.S. Appl. No. 13/341,741, dated Jan. 14, 2014.
Office Action from U.S. Appl. No. 13/370,252, dated Dec. 20, 2013.

* cited by examiner

FIG. 6b
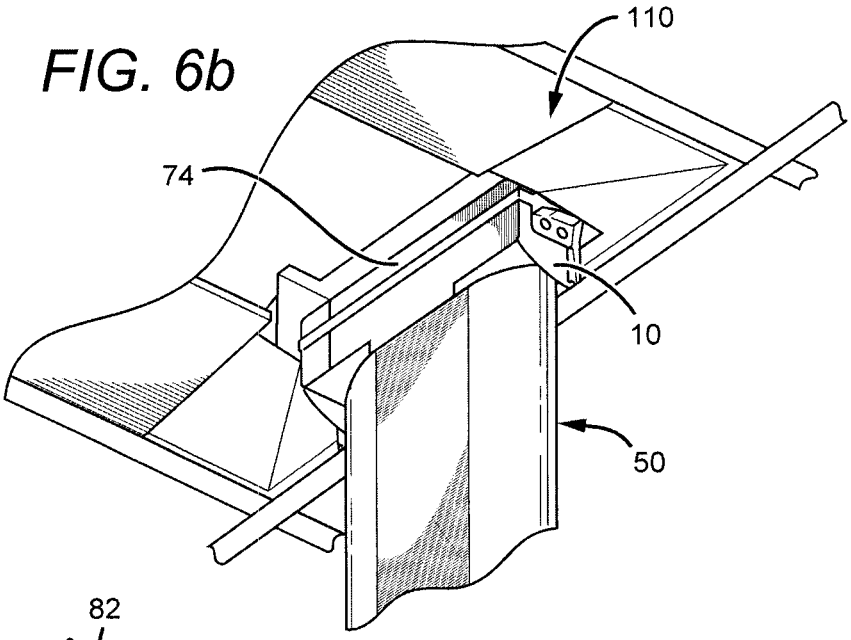
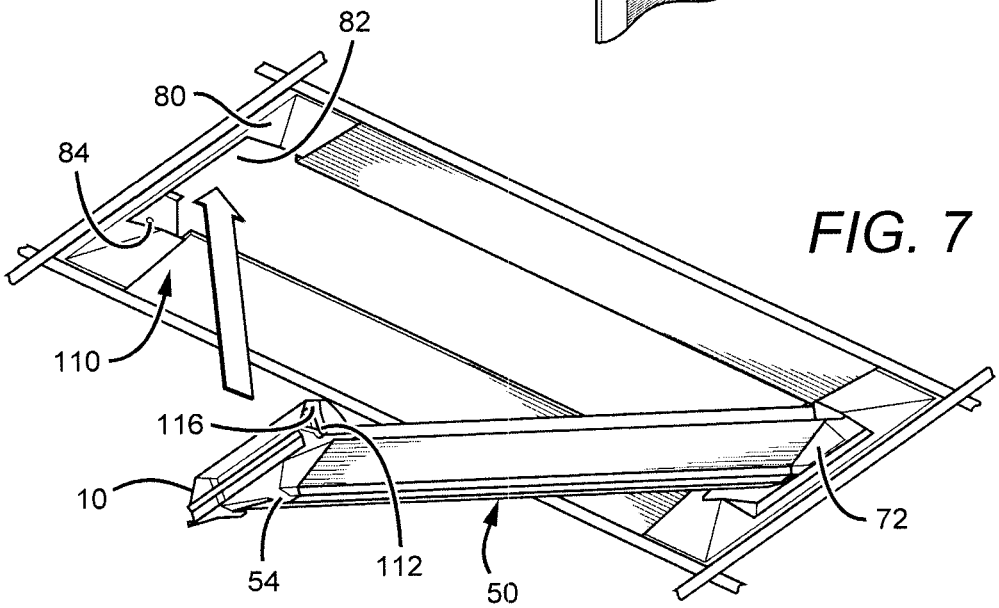
FIG. 7
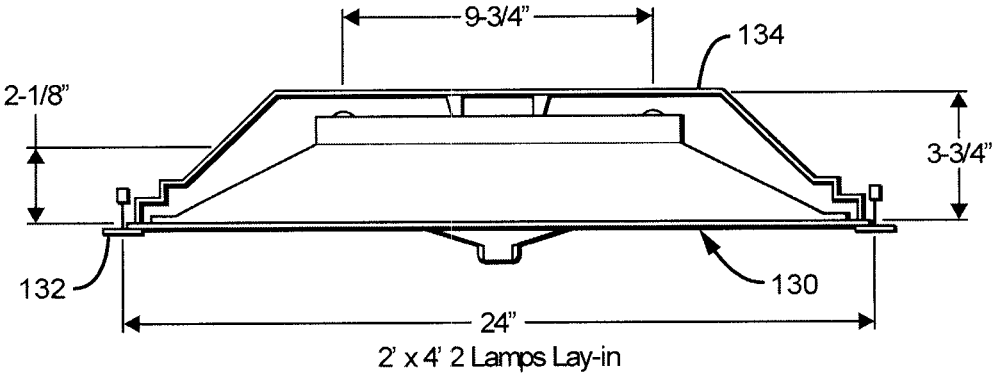
FIG. 9

MOUNTING SYSTEM FOR RETROFIT LIGHT INSTALLATION INTO EXISTING LIGHT FIXTURES

This application claims the benefit of U.S. Provisional Patent Application Ser. No. 61/584,092, filed on Jan. 6, 2012.

BACKGROUND OF THE INVENTION

Field of the Invention

The invention relates to retrofit systems and methods for lighting installations, and in particular, to retrofit systems and methods used to retrofit troffer-style lighting installations with LED light sources.

Description of the Related Art

Troffer-style fixtures are ubiquitous in commercial office and industrial spaces throughout the world. In many instances these troffers house elongated tubular fluorescent lamps or light bulbs that span the length of the troffer. Troffers may be mounted to or suspended from ceilings, such as being suspended by a "T-grid". Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, these troffers have been used with LEDs as their light source. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

There has been recent interest in upgrading existing troffer style lighting systems with LED sources (or engines) to capitalize on the above advantages. Current options for upgrading include complete fixture replacement such as by the commercially available CR Series Architectural LED Troffer, provided by Cree, Inc. Some features of these troffers are described in U.S. patent application Ser. No. 12/873,303, tilted "Troffer-style Fixture", and assigned to Cree, Inc. Performing complete fixture replacement can require penetrating the ceiling plenum by a skilled technician. This can be time consuming and expensive, and in many locations, building codes can require that a licensed electrician perform any work in the plenum space above a ceiling.

During the upgrade process, contamination may also be a concern, particularly in a hospital or clean room environment. In upgrade processes where the entire fixture is replaced, the sheet metal pan or housing of an existing troffer lighting system is removed. Removing the "host fixture" pan can generate dust which must be contained, and the area around the cleaned prior to resuming normal operations within the environment. Preventing dust is of particular concern in the case of especially dangerous dust such as asbestos. In certain environments, construction permits may be required for an upgrade process that requires removal of the troffer pan, which can add additional complications and costs.

Another alternative upgrade option is by a fixture retrofit where a new LED based light engine can be installed into the sheet metal pan of an existing troffer lighting system. This can provide the advantage of using light engines with design features such as reflectors, lenses, and power supplies which have been optimized for an LED-based system. It also allows light engines which are approved for use in other applications to be used in a retrofit application. Some retrofits can provide the advantage of not removing the existing troffer pan, with the pan acting as a barrier to the above-ceiling plenum space. Leaving the pan intact during the retrofit process does not disturb wiring connections, insulation, etc., found in the plenum space. Leaving the pan in place can also allow for work to be performed by non-licensed personal, which can result in a significant cost saving over work performed by licensed electricians. In some current retrofit products, replacement lamps or LED light engines are held into the existing fixture or sheet metal pan with brackets and screws. Some of these arrangements may result in penetrating the ceiling plenum, and some of these installations can be slow and labor intensive.

Other upgrades involve replacing the fluorescent light bulbs/tubes with replacement tubes having LEDs along their length. This upgrade can fit existing fluorescent lamp fixtures and can rely on the fixture's electrical ballast and wiring. However, compared to light engines designed to capitalize on the characteristics of LEDs, these replacement lamps can utilize much more energy for a given light output (lower efficacy), and can provide little or no cost benefit. In addition, the tubular format relies on the existing optical reflectors and lenses, which were designed for the light distribution characteristics of a fluorescent lamp.

SUMMARY OF THE INVENTION

The present invention is directed to lighting retrofit systems and methods that can be used with different light fixtures, but that are particularly adapted for use with retrofitting troffer-style fixtures with LED based light engines. Some embodiments of the present invention can be used to retrofit fluorescent based troffer-style light fixtures, with the retrofit systems being assembled without disturbing the lighting or troffer pan or housing ("troffer pan") for the lighting system being retrofitted. Some of these embodiments can comprise a mounting fixture or frame that can be mounted in an opening in a ceiling grid, and held in place between the grid and the troffer pan edge. The fixture or frame can comprise an opening for a light engine, with the engine being quickly and easily connected to electrical power in the troffer pan and then mountable within the frame opening. These embodiments can allow for the quick and easy construction of the retrofit system without the need for adhesives and fasteners such brackets and screws.

One embodiment of a system according to the present invention for mounting a light engine in a ceiling comprises an elongated light engine with at least two mount adaptors and end mounts configured for mount in a ceiling opening. Each of the end mounts is configured to mate with a respective one of the mount adaptors.

One embodiment of a system according to the present invention for mounting a light engine in a T-grid ceiling opening comprises a light emitting diode based light engine with at least two mount adaptors. A mount frame is included that is configured for mounting on the ceiling T-grid opening. The mount frame comprises mechanisms configured to mate with the mount adaptors.

One embodiment of a method according to the present invention for mounting a light engine in a ceiling opening comprises providing a light engine with a plurality of mount adaptors. A mounting frame is mounted within a ceiling opening with the mounting frame having mechanisms to engage with the mount adaptors. A first one of the plurality of mount adaptors is engaged in the mounting frame and the light engine is connected to a power source. A second one of the mount adaptors is engaged in the mounting frame to hold the light engine in the ceiling opening.

One embodiment of a method according to the present invention for retrofitting a fluorescent light fixture in a T-grid ceiling opening comprises removing existing components of the fluorescent light fixture in the T-grid ceiling opening. A plurality of end mounts are mounted within and at least partially spanning the T-grid ceiling opening, with each of the end mounts having a connection mechanism. One end of a light engine is connected to a first end mount connection mechanism and a second end light engine is connected to a second end mount connection mechanisms. The end mounts are arranged to hold the light engine in the T-grid ceiling opening.

These and other further features and advantages of the invention would be apparent to those skilled in the art from the following detailed description, taken together with the accompanying drawings, in which:

BRIEF DESCRIPTION OF THE DRAWINGS

FIG. 6*b* is another bottom perspective view with a light engine mounted to a mounting frame in a troffer pan opening;

FIG. 7 is a bottom perspective view of a troffer pan opening with the light engine being pivoted in a mounting frame to its final installed position according to the present invention;

FIG. 9 is a sectional view of a troffer pan opening with one embodiment of a retrofit system according to the present invention;

DETAILED DESCRIPTION OF THE INVENTION

Figure 1A:
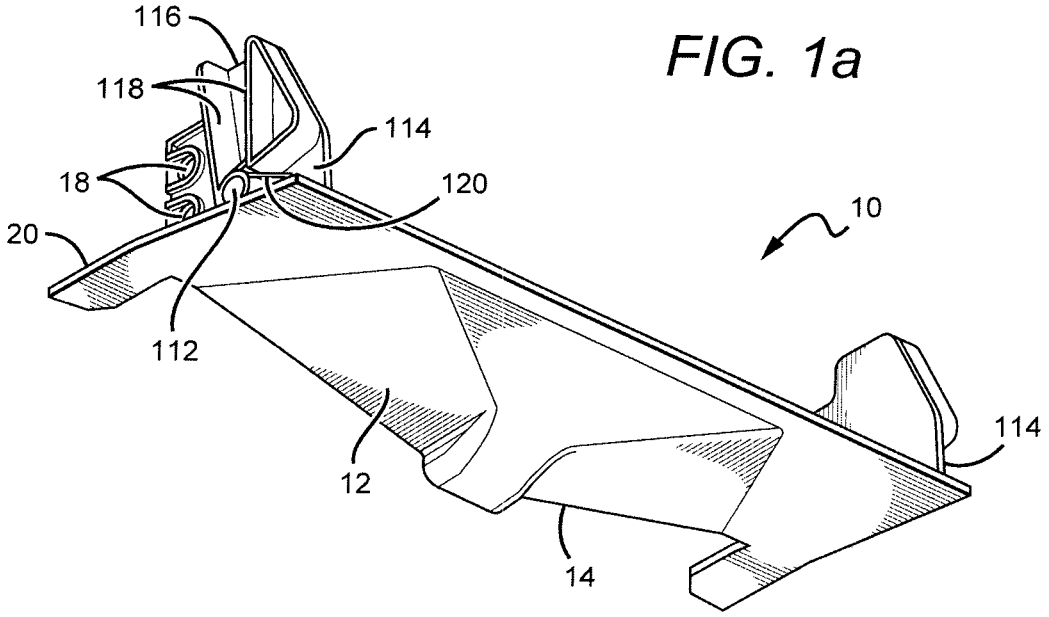
FIG. 1*a* is a bottom perspective view of one embodiment of an outer mount adaptor according to an embodiment of the present invention.

Embodiments of the present invention provide retrofit systems that can be used with different light fixtures, but that are particularly adapted for use with troffer-style fixtures. The retrofit systems can be used with many different light sources but are particularly well-suited for use with solid state light sources or light engines, such as those utilizing LEDs. Some embodiments of the present invention comprise a mechanical mounting system for installing an LED light engine within an existing lighting system housing or pan, such as a troffer pan, without penetrating the ceiling plenum.

By leaving the existing troffer pan in place, embodiments of the present invention can rely on the troffer pan to act as a barrier against the spread of fire and smoke. In many areas, local codes may not allow for the use of plastic components inside the plenum space above the ceiling. This is due to concerns that if a fire occurred in one room, toxic smoke from burning plastics could be carried to other locations which share the air plenum. Maintaining the host fixture's troffer pan as a barrier to this spread of toxic smoke can allow for the use of lower cost plastic parts above the ceiling line in the troffer pan. Without the troffer pan barrier, these plastic parts might otherwise not be allowed in the plenum space.

Some embodiments of the present invention can comprise components, inserts, panels or mounts arranged on and spanning across the ceiling T-grid and spanning across the existing pan, to form a mounting frame or assembly for a light engine. In some embodiments mounting frame can rest on the lip of the T-grid and at least partially spanning the T-grid opening to provide opening in the troffer sized for the light engine. In some of these embodiments, the mounting frame can be located in and supported directly by the ceiling's T-grid, and does not rely on the existing troffer pan for support or location. Embodiment of the mounting frames can be erected quickly and easily without requiring tools, fasteners or adhesives, but it is understood that in other embodiments they can be used.

The light engine can be provided with a mounting feature that quickly and easily engages the mounting frame. In some embodiments the mounting feature can comprise one or more mount adaptors that can be fitted on a light engine prior to engaging the mounting frame. In some embodiments the light engine can be elongated and can have a mount adaptor at each end. The mount adaptors can comprise a one piece mechanism, or can comprise multiple pieces that cooperate to form the adaptors at each end of the light engine. In some embodiments, the mount adaptors can comprise inner and outer mount adaptor portions that mate together over the end of the light engine to form the mount adaptor. In some embodiments, the inner and outer mount adaptors can have features that allow them to snap together, with the features also allowing for their separation. In other embodiments, the mount adaptor can be a single piece structure that is affixed to the light engine, and in some embodiments it can be removably affixed to the light engine. In other embodiments, the mount adaptor can be formed as integral part of the light engine, with the mount adaptor being a permanent part of the light engine or being interchangeable.

Multiple piece mount adaptors, and/or mount adaptors that can be removably mounted to the light engine, provides for increased flexibility in matching particular light engines to a particular mounting frame or feature in a ceiling opening. Different mount adaptors can be selected based on the particular mounting frame. In the case of multiple piece mount adaptors, the particular inner and outer mount adaptor can be selected based on the particular light engine or mounting frame. In some embodiments, a particular light engine can utilize the same inner mount adaptor that can be matched with different outer mount adaptors depending on the particular mounting frame or feature. Similarly a particular outer mount adaptor used for a particular frame, can be matched with many different inner adaptors to allow for use with different types of light engines. This matching of mount adaptor components provides for flexibility in utilizing different types of light engines with different types of mounting frames or features.

It is understood that the mount adaptors according to the present invention can comprise more than two pieces, while still providing these flexibility advantages. In the case of interchangeable single piece mount adaptors, different mount adaptors can be mounted to the light engine with different mounting frames or features. The flexibility of the present invention allows for the use of many different integral or separately mounted mount frames, to be used in conjuction with many different light engines with integral or separately attached mount adaptors.

The light engines can also comprise different features to allow for ease of light engine installation. In some embodiments, the light engine can partially engage the mounting frame during installation and can hang from one end in the mounting frame by the engagement point for final wiring connections. When in the hanging position, the light engine can be fully supported by the mounting frame, freeing the installer's hands. In this position, the wiring connections to the light engine are exposed to the installer, and are located close to the existing troffer pan for easy installation. This allows for one installer to perform both the installation and wiring "hands-free" and without assistance. After wiring, the light engine can be moved into final position and locked into place, completing the installation.

Different embodiments of the present invention also allow for the light engine to be installed in the mounting frame without the use of tools. The light engine can be pivoted about one end, from the hanging position into its final position, reducing the number of installation steps and installation time. In other embodiments, the light engine can be pivoted about one side, from the hanging position to its final position. In other embodiments, the features that lock the light engine in its final position can be recessed to prevent tampering and to provide a smooth visual surface. In other embodiments, the parts of the retrofit systems according to the present invention can be constructed of flame-resistant materials so that the wiring between the light engine and the existing fixture pan does not require special protection, such as flexible wiring conduit.

Some embodiments of the present invention can comprise end mounts and side panels that are installed on the T-grid to form the mounting frame. The side panels can engage and cooperate with the end mounts such that the end mounts are locked into position by the side panels and prevented from moving. As a result, no additional adhesives and fasteners may be needed to locate the end mounts, reducing installation time and cost. It is understood, however, that other embodiments can use adhesives and fasteners to hold the end mounts or side panels in place.

The present invention is described herein with reference to certain embodiments, but it is understood that the invention can be embodied in many different forms and should not be construed as limited to the embodiments set forth herein. In particular, the present invention is described below in regards to certain retrofit systems that can be used to retrofit and/or upgrade troffer-style fixtures or lighting systems, but it is understood that the system can be used to retrofit and/or upgrade different types of lighting systems. The retrofit systems can also be used with many different light systems, sources and engines beyond those described herein, with many being LED based.

It is understood that when an element can be referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

Embodiments of the invention are described herein with reference to cross-sectional view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

As mentioned above, embodiments of the present invention can comprise a mechanical mounting system for installing an LED light engine within an existing lighting system pan, such as the opening of a troffer pan, without penetrating the ceiling plenum. The light engine can be provided with a mounting feature or mount adaptor that quickly and easily engages the mounting frame in the opening of the troffer pan. Different mount adaptors can be arranged in different ways, with some being provided as a single piece adaptor, and others being provided as a multiple piece adaptor mounted to a light housing.

Figure 1B:
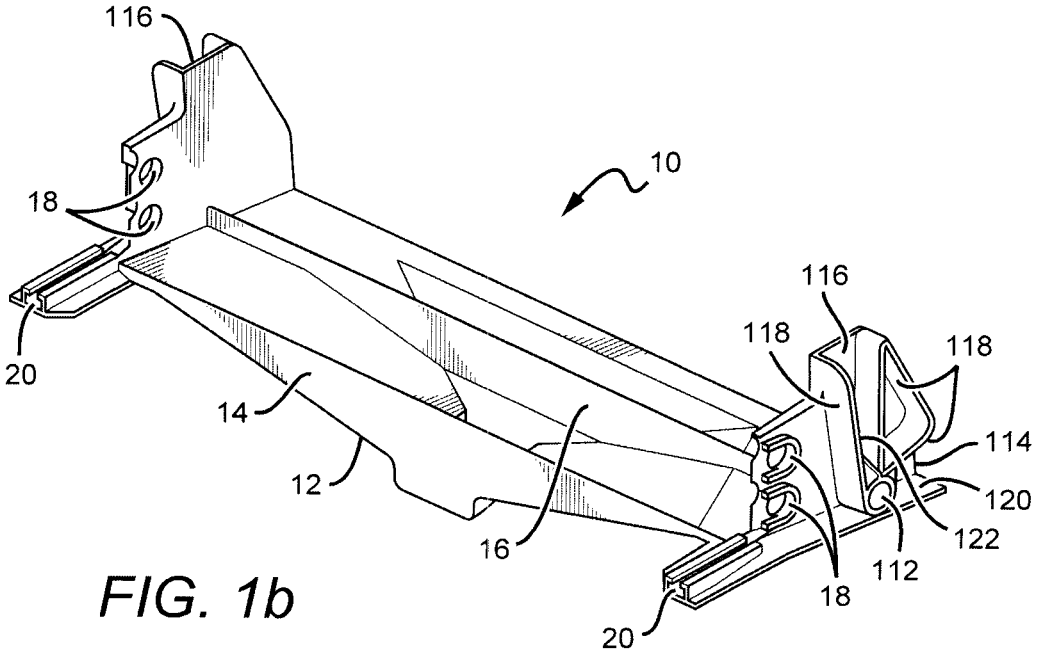
FIG. 1*b* is a top perspective view of the outer mount shown in FIG. 1*a;*

FIGS. 1*a* through 1*d* show one embodiment of a mount adaptor according to the present invention comprising two pieces that cooperate together as an outer and inner mount adapters that form a single mount adapter. In some embodiments the pieces cooperate together to form a mount adaptor at each end of a light engine. FIGS. 1*a* and 1*b* show one embodiment of an outer mount adaptor 10, having an outer surface 12 that faces the room when the adaptor is mounted to a light engine and the light engine is mounted in the retrofit system. The outer mount adaptor 10 is arranged so that it can be placed at the end of a light engine (as described below), and comprises a first abutment surface 14 sized to abut against the lower portion of the end surface of a light engine. The mount adaptor 10 also comprises a second abutment surface 16 that can abut against a different end surface of a light engine, such as that of a circuit box attached to the end of a light engine. The circuit box can house electronic components used to drive and control the light sources such as rectifiers, regulators, timing circuitry, and other elements.

The outer mount adaptor 10 also comprises mounting holes 18 arranged to cooperate with the second piece of the two piece mounting adaptor when mounting the two pieces to a light engine. The mount adaptor 10 also comprises slots 20 arranged to cooperate with tabs on the inner mount adapter (described below) of the two piece mounting adaptor. The outer mount adapter also comprises pin holes 112 that cooperate with a plunger pin in the mounting frame when mounting a light engine to the mounting frame, as described in detail below.

Figure 1C:
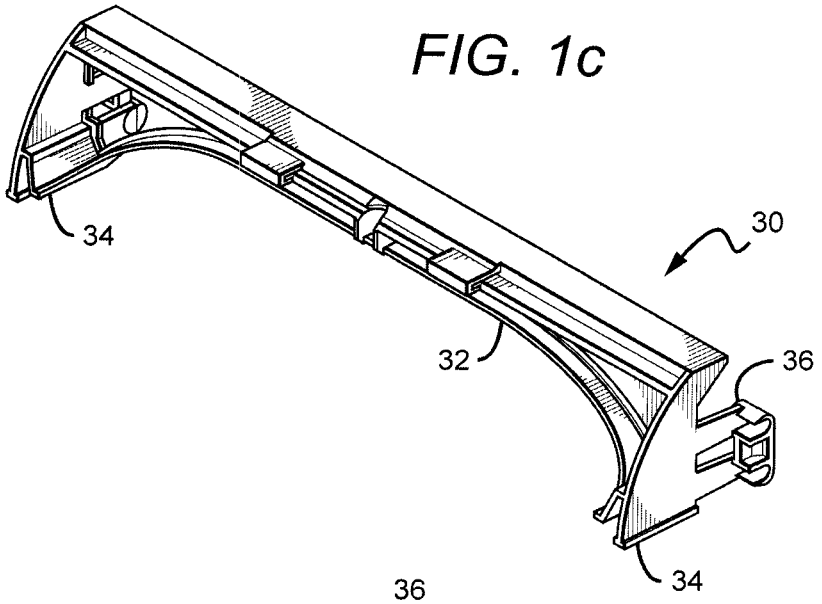
FIG. 1*c* is a top perspective view of one embodiment of an inner mount adaptor according to an embodiment of the present invention.
Figure 1D:
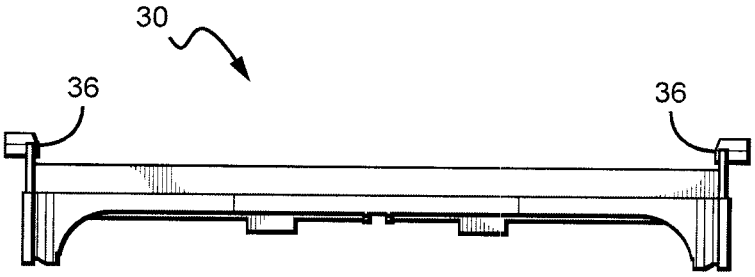
FIG. 1*d* is a top perspective view of the inner mount shown in FIG. 1*d;*

FIGS. 1*c* and 1*d* show one embodiment of the second piece of the two-piece mount adaptor, or inner mount adaptor 30 that is arranged so that it faces the inner portion of the troffer pan on a light engine, instead of the room. The inner adaptor 30 comprises a shaped surface 32 to match that of the inner surface of a light engine. The inner mount adaptor 30 also comprises tabs 34 that are arranged to slide in the slots 20 of the outer adaptor 10, shown in FIGS. 1*a* and 1*b*. The inner mount adaptor 30 further comprises mounting pins 36 sized and arranged to mate with mounting holes 18 of outer mount adaptor 10, shown in FIGS. 1*a* and 1*b*.

Figure 2A:
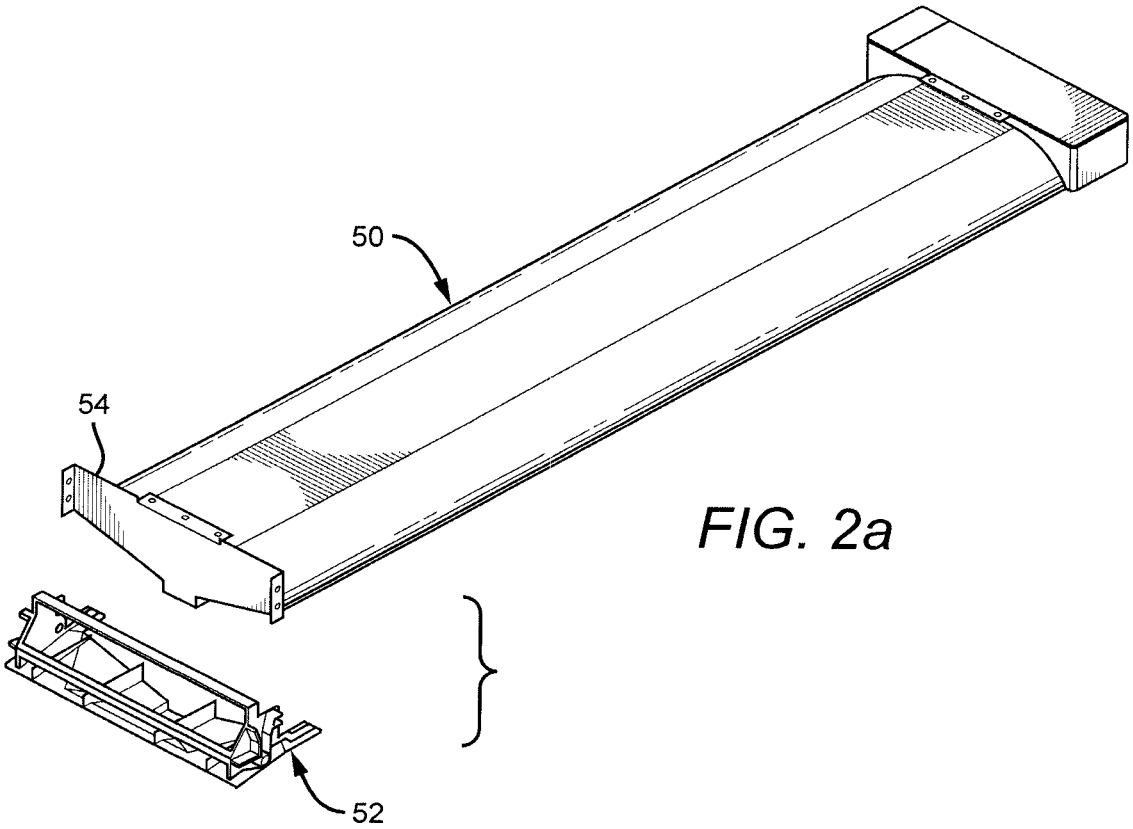
FIG. 2*a* is a top perspective view of a light engine with one embodiment of an outer mount adaptor according to the present invention.
Figures 2B, 2C:
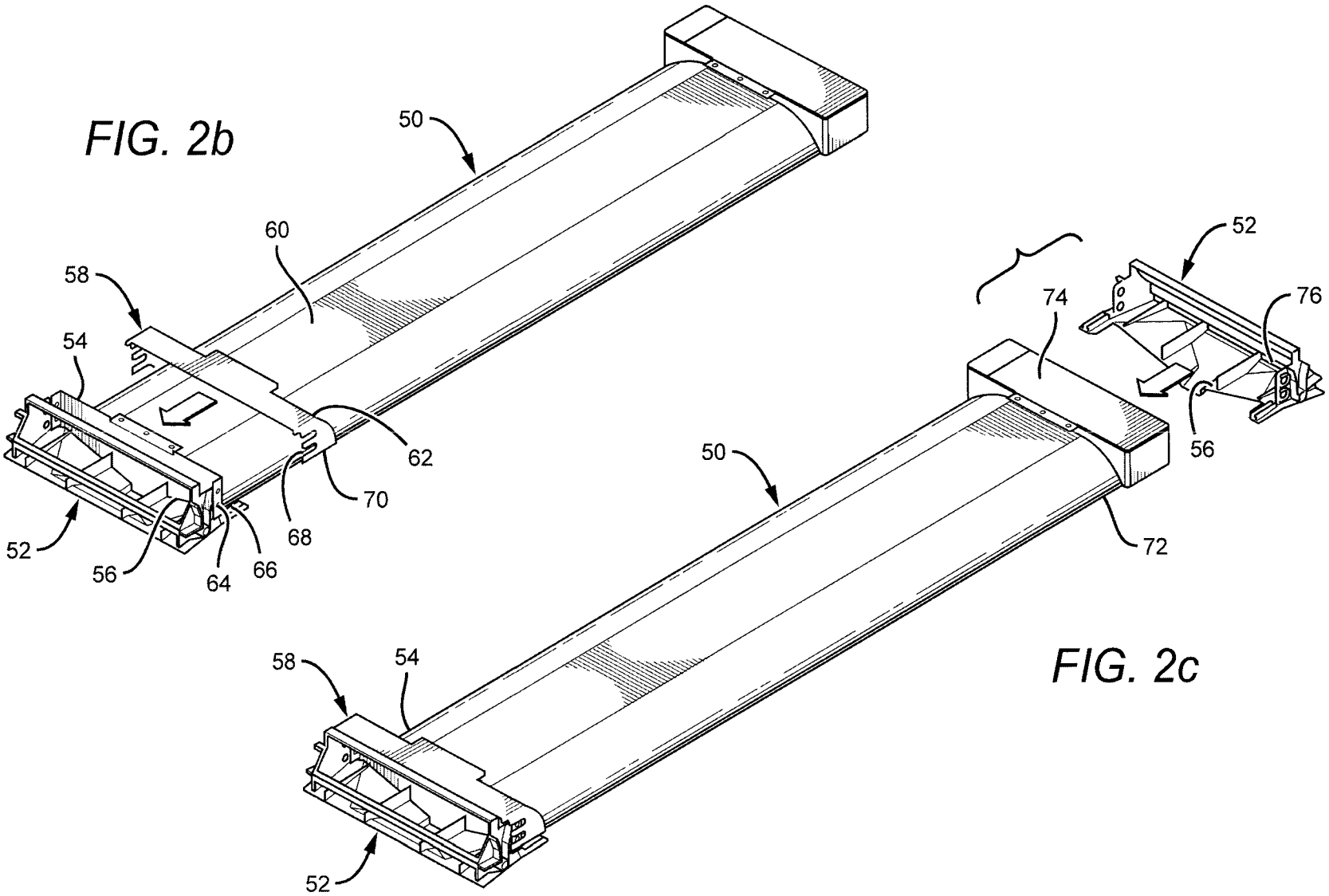
FIG. 2*b* is a top perspective view of the light engine in FIG. 2*a* with one embodiment of an inner mount adaptor according to the present invention.
FIG. 2*c* is a top perspective view of a light engine shown in FIG. 2*b* with a second outer mount adaptor according to the present invention.

FIGS. 2*a* through 2*c* show one embodiment of a light engine 50 with a mount adaptor being mounted to both ends according to the present invention. The two piece mounting adaptor can be similar to the inner and outer mount adaptors 10 and 30 described with reference to FIGS. 1*a* through 1*d*. Referring first to FIG. 2*a* an outer mount adaptor 52 is placed at a first end 54 of the light engine 50. Referring now to FIG. 2*b*, when the outer mount adaptor 52 is in place, its first abutment surface 56 is against the lower portion of the light engine's first end 54. An inner mounting adaptor 58 is then placed over the inner surface 60 of the light engine 50, with the shaped surface 62 of the inner mount adapter 58 being on the light engine's inner surface 60. The inner mounting adapter 58 can then be slid toward the outer mounting adaptor 52, with the holes 64 and slot 66 of outer mount adaptor 52 mating with the inner mount adaptor's pins 68 and tab 70, respectively. This mating attaches the inner and outer mount adaptors 52, 58 to one another, to form a mounting adaptor over the light engine's first end 54 as best shown in FIG. 2*c*.

With continued reference to FIG. 2*c*, a two piece mounting adaptor can similarly be mounted to the second end 72 of the light engine 50. In this embodiment, however, the second end 72 comprises a circuit box 74 as described above. The second abutment surface 76 of the outer mounting adaptor 52 rests against the end surface of the circuit box 74, with the first abutment surface 56 against the lower portion of the second end 72.

Figure 2D:
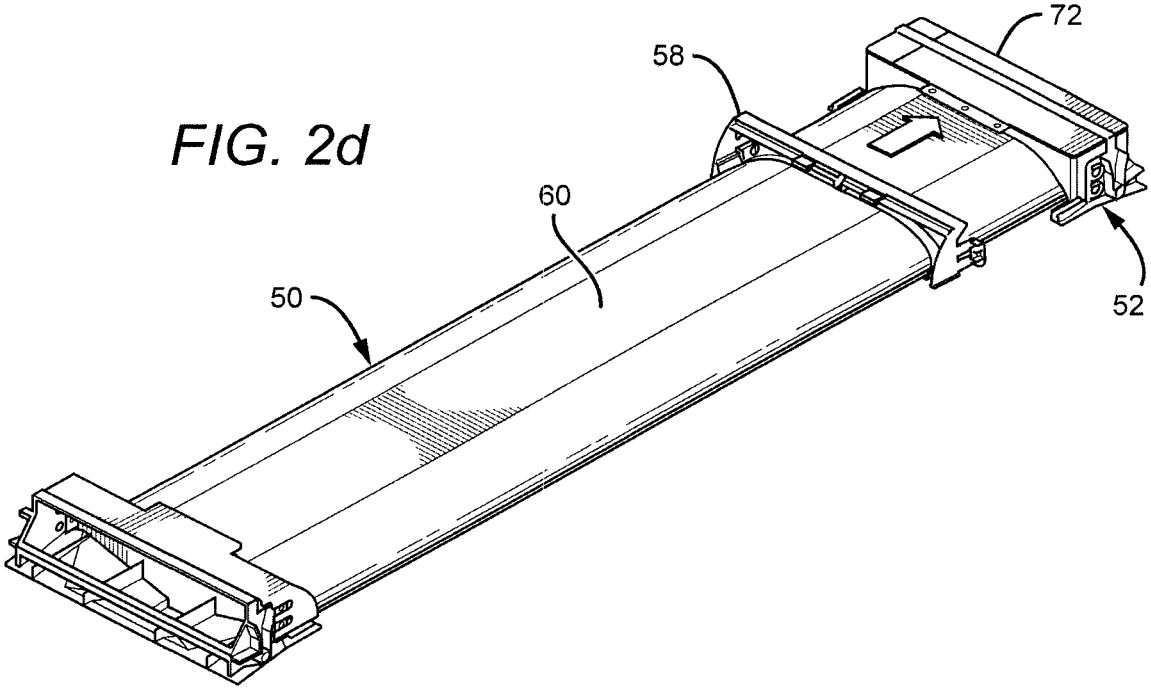
FIG. 2*d* is a top perspective view of the light engine in FIG. 2*c* with a second inner mount adaptor according to the present invention.

Referring now to FIG. 2*d*, an inner mounting adaptor 58 is included on the light engines inner surface 60 and is slid toward the outer mount adaptor 52 to mate the two in the same way the two mated at the first end 54 of the light engine 50. The mated mount adaptors are sized and shaped to accommodate the circuit box, while still forming a reliable mounting adaptor over the second end 72. The outer and inner mount adapters 52, 58 (as well as mount adaptors 10, 30 described above) are arranged so that they can be mounted over the first and second ends without the need for adhesives or fasteners. The outer and inner adapters 52, 58 can be made of many different materials and can be fabricated in many different ways, with one embodiment comprising injection molded plastics.

The mount adaptors according to the present invention are uniquely arranged so that they can be mounted to both ends of the light engine even though the ends have different components and are shaped differently. As described above, this two piece mating arrangement allows for flexibility of using different inner and outer mount adaptors depending upon the particular mount frame or light engine. In the embodiment described above, the outer mount adaptor comprises first and second abutment surfaces 56, 76 to account for the circuit box included at the second end of the light engine. The second abutment surface is only utilized on the second end of the light engine, but the outer mount can still be used at the first end. This provides the advantage of using the same mount adaptors at both ends and not having to stock multiple types of mount adaptors.

Figure 3A:
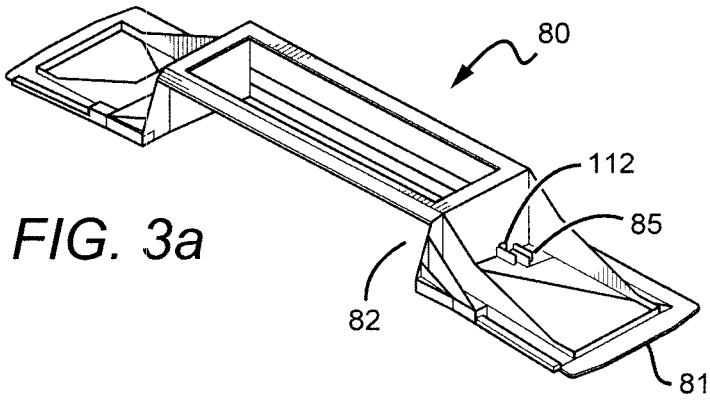
FIG. 3*a* is a top perspective view of one embodiment of an end mount according to the present invention.
Figure 3B:
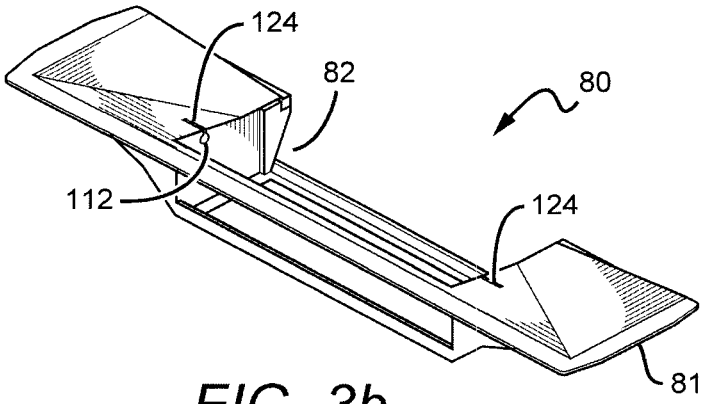
FIG. 3*b* is bottom perspective view of the end mount shown in FIG. 3*a;*

The present invention also comprises a mounting frame that can be mounted in the opening of a troffer pan, with the mounting frame having an opening for the light engine. FIGS. 3*a* and 3*b* show one embodiment of an end mount 80 that is sized to fit within a troffer pan opening, the end mount 80 having a perimeter section 81 on three sides that is adapted for resting on a ceiling T-grid. The end mount 80 further comprises a cavity 82 sized to hold one of the mounting adaptors at the ends of the light engine, with the end mount further comprising plunger pins 84 (shown in FIG. 3*c*) to hold the mounting adaptors in the cavity 82 when mounting the light engine to the mounting frame (as further described below).

Figure 3C:
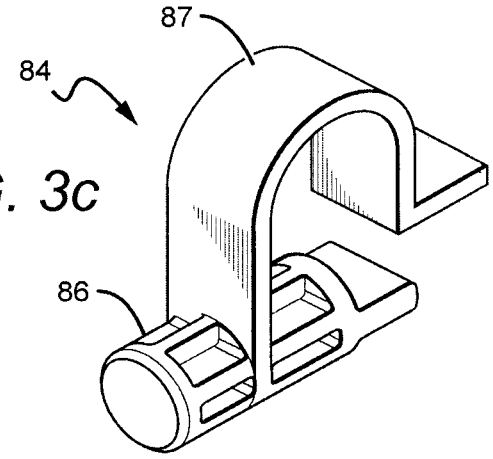
FIG. 3*c* is a top perspective view of one embodiment of a plunger pin according to the present invention.

The plunger pins 84 can be arranged in many different ways, with FIG. 3*c* showing one embodiment of a plunger pin 84 according to the present invention. The plunger pin 84 can be separately molded from the end mount 80 and can be shaped to be mounted to the end mount's plunger pin cradle 85 (shown in FIG. 3*a*). When mounted in the cradle 85, the cylindrical portion 86 of the plunger pin 84 extends through the surface of the end mount 80. The plunger pin arc section 87 provides a spring action/motion for the cylindrical portion 86 that allows for the pin's cylindrical portion to retract back into the end mount 80 under force, and to extend back out when the force is removed. This is only one example of the many ways that the retracting pin can be arranged, and only one of the many mechanisms that can provide a spring action. For example, in alternative embodiments known coil springs can be used to provide the desired spring action.

Figure 4:
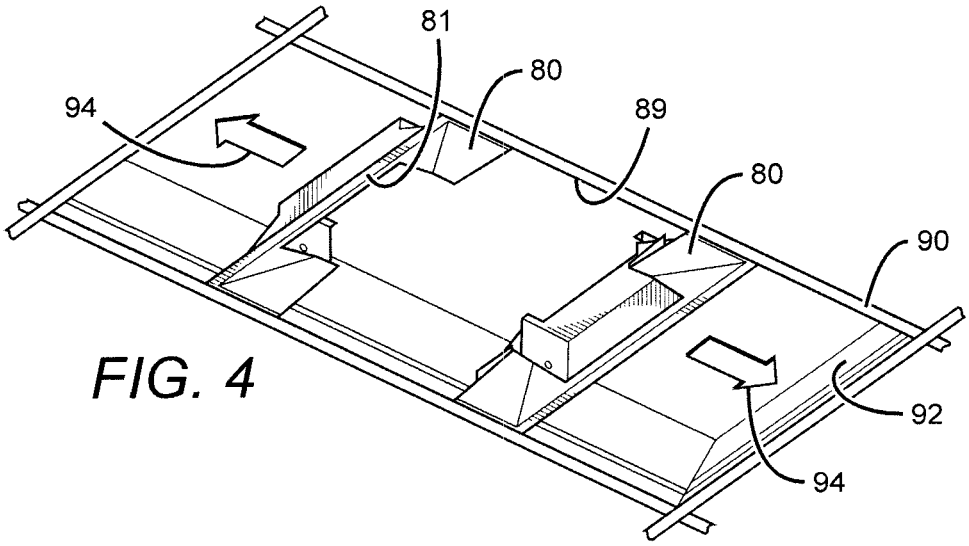
FIG. 4 is a bottom perspective view of a troffer pan opening with two end mounts according to the present invention.

FIG. 4 shows two end mounts 80 being mounted within a troffer pan opening 89, with portions of the perimeter section 81 on opposing sides of the end mounts 80 being arranged between the T-grid 90 and the edge of the troffer pan 92. During installation, each of the end mounts 80 can be held in the troffer pan opening 89 off-angle, and then rotated until the perimeter section 81 catches on the T-grid. The end mounts can be further rotated to their position shown in FIG. 4, and the end mounts 80 can then be slid on the T-grid to opposing ends of the troffer pan opening 89 as shown by arrows 94.

Figure 5A:
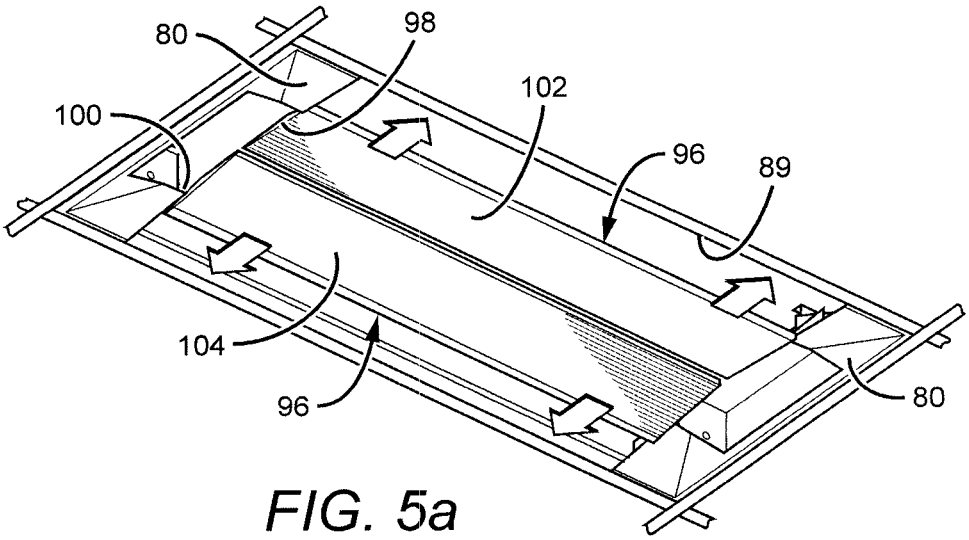
FIG. 5*a* is a bottom perspective view of the troffer pan opening in FIG. 4, with two side panels according to the present invention.
Figure 5B:
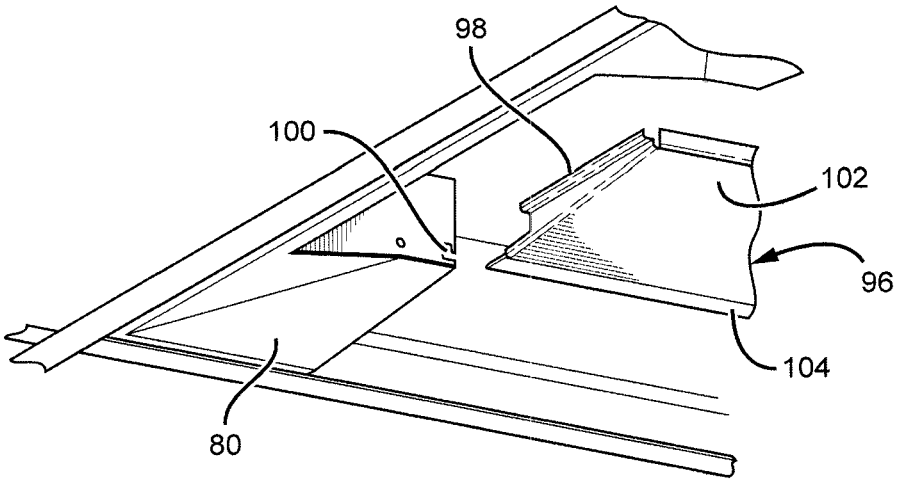
FIG. 5*b* is a bottom perspective view of a troffer pan opening with a side panel according to the present invention.
Figure 5C:
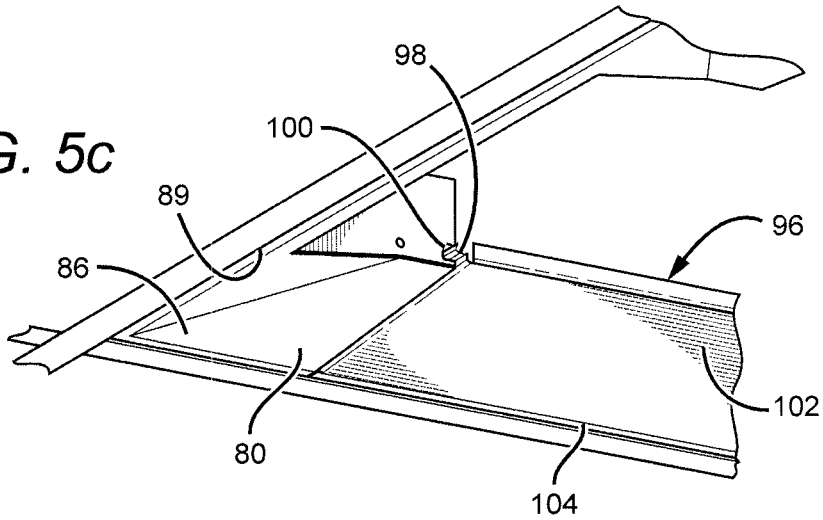
FIG. 5*c* is a bottom perspective view of the troffer pan opening in FIG. 5*b*, with the side panel mated with the end mount.

Referring now to FIGS. 5*a* through 5*c*, the end mounts 80 are arranged at opposing ends of the troffer pan opening 89. To complete the light engine mounting frame, side panels 96 can be mounted between the end mounts 80, along the longitudinal edge of the troffer pan opening 89. The side panels 96 can be mounted in the troffer pan opening 89 in many different ways, and in the embodiment shown the ends of each side panel 96 comprises a side panel tab 98. Each of the end mounts 80 also comprises two side panel slots 100, with each side panel tab 98 arranged to mate with one of the end mount slots 100. Referring to FIGS. 5*a* and 5*b*, during installation one of the side panels can be held near the center of the troffer pan opening 89 with the side panel tab 98 at each end of the side panel 96 aligned with its respective end mount slot 100. As the panel 96 is moved out to the longitudinal edge of the troffer opening 89, the tab 98 slides into its respective slot 100. When the side panel 96 reaches the edge of the troffer opening 89, the tab 98 is mostly or entirely in its slot 100, as shown in FIG. 5*c*. When the side panel 96 is fully installed, its outer surface 102 is angled to match the angle on the end mount's outer surface 86. The side panel also has a side panel perimeter section 104 that is arranged between the T-grid and the edge of the troffer pan when the side panel 96 is fully installed.

When the side panels 96 are in place on the end mounts 80, the mounting frame is complete. The side panels 96 hold the end mounts 80 apart and in their proper location at opposing ends for the troffer pan opening 89. The entire side panel can be constructed without the need for adhesives or fastener such as brackets or screws. Like the components described above, the end mounts 80 and side panels 96 can be made of many different materials, with some embodiments being made of injection molded plastics.

Figure 6A:
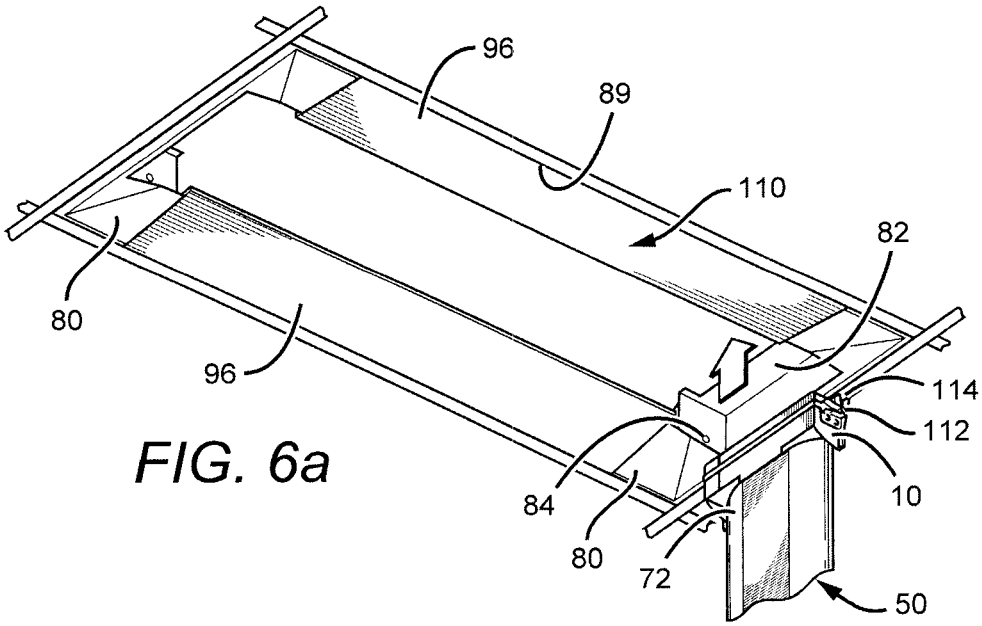
FIG. 6*a* is a bottom perspective view of a troffer pan opening with the light engine being mounted in a mounting frame.

FIG. 6*a* shows a completed mounting frame 110 in a troffer pan opening 89, with the mounting frame 110 comprising opposing end mounts 80 and opposing side panels 96. As discussed above, the end mounts 80 have opposing plunger pins 84 that are arranged to hold the light engine 50 by its mount adapter. The plunger pins 84 are arranged such that they can be pushed into the end mount 80 and can then extend again from the end mount 80 when the pushing force is removed. Referring to FIGS. 1*a* and 1*b* in conjunction with FIG. 6*a*, the outer mount adapter 10 (or outer mount adaptor 52 described above) has two pin holes 112 arranged to mate with the plunger pins 84 in the outer mount adaptor 10 when mounting the light engine to the mounting frame. The outer mount adaptor 10 also comprises first and second pin guides 114, 116 associated with each of the pin holes 112. Each of the pin guides has tapering edges 118 that reduce the opening of guides 114, 116 moving closer to its respective pin hole 112. In installation of the light engine 50 in the frame 110, this tapering allows for a wider opening in each guide 114, 116 with its respective one of the plunger pins 84 when first aligning the light engine 50 with the pins 84. This results in the initial engagement with the plunger pins 84 being less exacting and easier on the installer. After the initial engagement, and as the light engine 50 is moved closer to its final installed position, the taper in the guides reliably directs the plunger pins 84 to their respective one of the pin holes 112.

Each first guide 114 also comprises a first ramp 120 and each second guide comprises a second ramp 122, with both the first and second ramps 120, 122 being adjacent one of the pin holes 112. Each of the ramps 120, 122 starts at the bottom surface of its respective guide 114, 116 increases in height moving closer to its respective pin hole 112. Immediately adjacent to the pin hole 112, each ramp 120, 122 is the height of its respective pin hole 112. During installation of the light engine 50, each ramp 120, 122 is arranged to push a respective one of the outer mounting adaptor plunger pins 84 in as the lighting engine 50 is moved to its final mounted position. When the light engine is in its final position, the plunger pins 84 will be over a pin hole 112, which allows the plunger pins 84 to pop back out and into its pin hole 112. This action holds the outer mounting adapter 10 in the end mount 80, and as a result, holds the light engine 50 in the end mount 80 of the mounting frame 110.

Referring now to FIG. 6*a*, the light engine 50 can initially be installed in the mounting frame 110 in an approximate vertical orientation, or perpendicular to the mounting frame 110. The outer mount adaptor 10 at the second end 72 of the light engine 50 can be aligned with the cavity 82 of the end mount 80. In this orientation, the first pin guides 114 are aligned with the plunger pins 84. As the second end 72 of the light engine 50 is moved up into the cavity 82, the pin guides 114 direct the plunger pins 84 toward the pin holes 112, until the plunger pins 84 pop into and engage in the pin holes 112. The light engine is now in the position as shown in FIG. 6*b*, with the pin and hole engagement holding the outer mount adapter 10, and the light engine 50 in the mounting frame 110. In this position the installer can remove his hands from the light engine, freeing both hands to connect the appropriate wiring to the circuit box 74.

Many different methods of making electrical connection can be used such wire-to-wire splices, terminal block connections, and connectors commercially available by manufacturers such as Ideal Industries, Inc., Wago Corporation, and Tyco International Ltd. Wire splices can include crimp-type splices, wire nuts, heat activated methods including wire solder joints and those employing shrink tubing, tool-free spring connect or cage-clamp splice connections, screw-terminal splices, and the like. Terminal block connections may include PCB-mounted terminal blocks with screw terminals, spring loaded or cage-clamp terminals. Those of skill in the art will appreciate that many different types of connectors many be used such wire-to-wire, wire-to-board connectors, as well as those with integral or separable pins or sockets.

Figure 8:
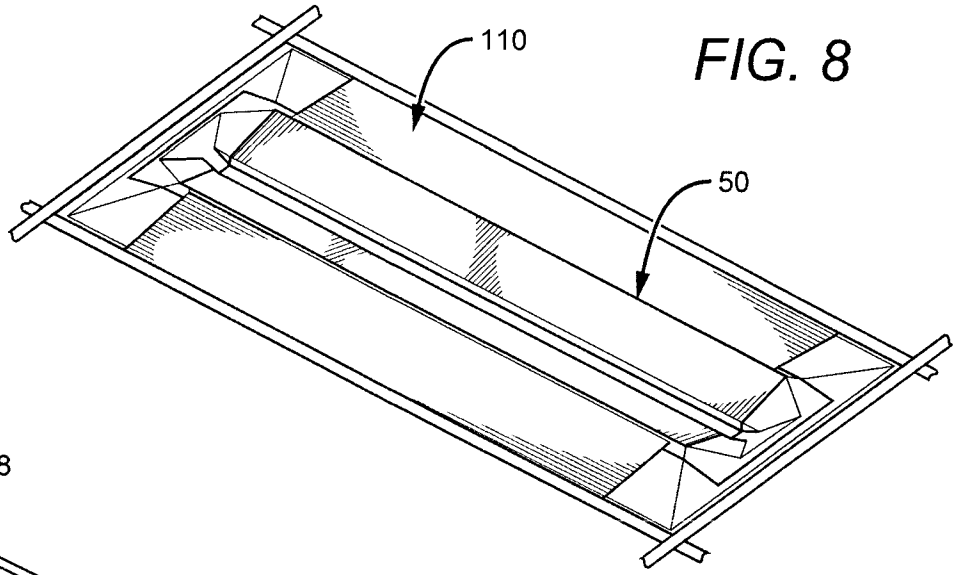
FIG. 8 is a bottom perspective view of the troffer pan opening of FIG. 7, with the light engine installed in the mounting frame.

Referring now to FIG. 7, when the wiring is complete the light engine 50 can be ready for final steps of installation. The light engine 50 can be pivoted from its perpendicular position to the first end 54 if the light engine 50 is toward the mounting frame 110. The outer mount adapter 10 at the first end 54 moves into the cavity of its end mount 80. In this orientation, the second pin guides 116 are aligned with the plunger pins 84. As the first end 54 of the light engine 50 is moved up into the cavity 82, the pin guides 116 direct the plunger pins 84 toward the pin holes 112, until the pins 84 pop into and engage in the pin holes 112. This holds the light engine 50 in its final mounted position in the mounting frame 110, as shown in FIG. 8.

Again, the light engine can be mounted in the mounting frame without the need for adhesives and fasteners such as brackets or screws. In some embodiments, entire retrofit systems according to the present invention can be quickly and easily installed without the need for these adhesives and fasteners.

The retrofit system can have many different mechanisms and arrangement for removal of the light engine 50. In the embodiment shown, and in reference to FIG. 3*b*, the end mount 80 can comprise a retraction slot 124 that is adjacent the plunger pins 84, with each slot being sized for insertion of a bladed tool, such as a screwdriver. When the light engine 50 is fully installed as shown in FIG. 8, and the plunger pin 84 (shown in FIG. 3*c*) is extended through the pin hole 112, the bladed tool can be inserted in the slot 124 to engage the pin portion behind the surface of the end mount 80, and then slid away from the light engine to retract the plunger pin 84 to disengage them from their respective pin hole 112 (all described above). This can allow for removal of the first and/or second ends 54, 72 of the light engine 50 to be removed from their respective end mount cavity 82 for removal of the light engine 50 from the mounting frame. The mounting frame can then be removed using the reverse of the installation steps described above. Different embodiments can also include plugs to fill and cover slots to give the frame a more finished appearance. Similar plugs can also be included in other openings in the frame or other portions of the retrofit system.

FIG. 9 shows one embodiment of a cross-section of a retrofit system 130 arranged on a T-grid 132 in a troffer pan 134. The overall height of the system is less than 4", but other embodiments can have different heights. The system 130 is installed in a 2' by 4' 2 lamp troffer pan, but it is understood that other systems can be arranged for use with other troffer pans.

Figure 10:
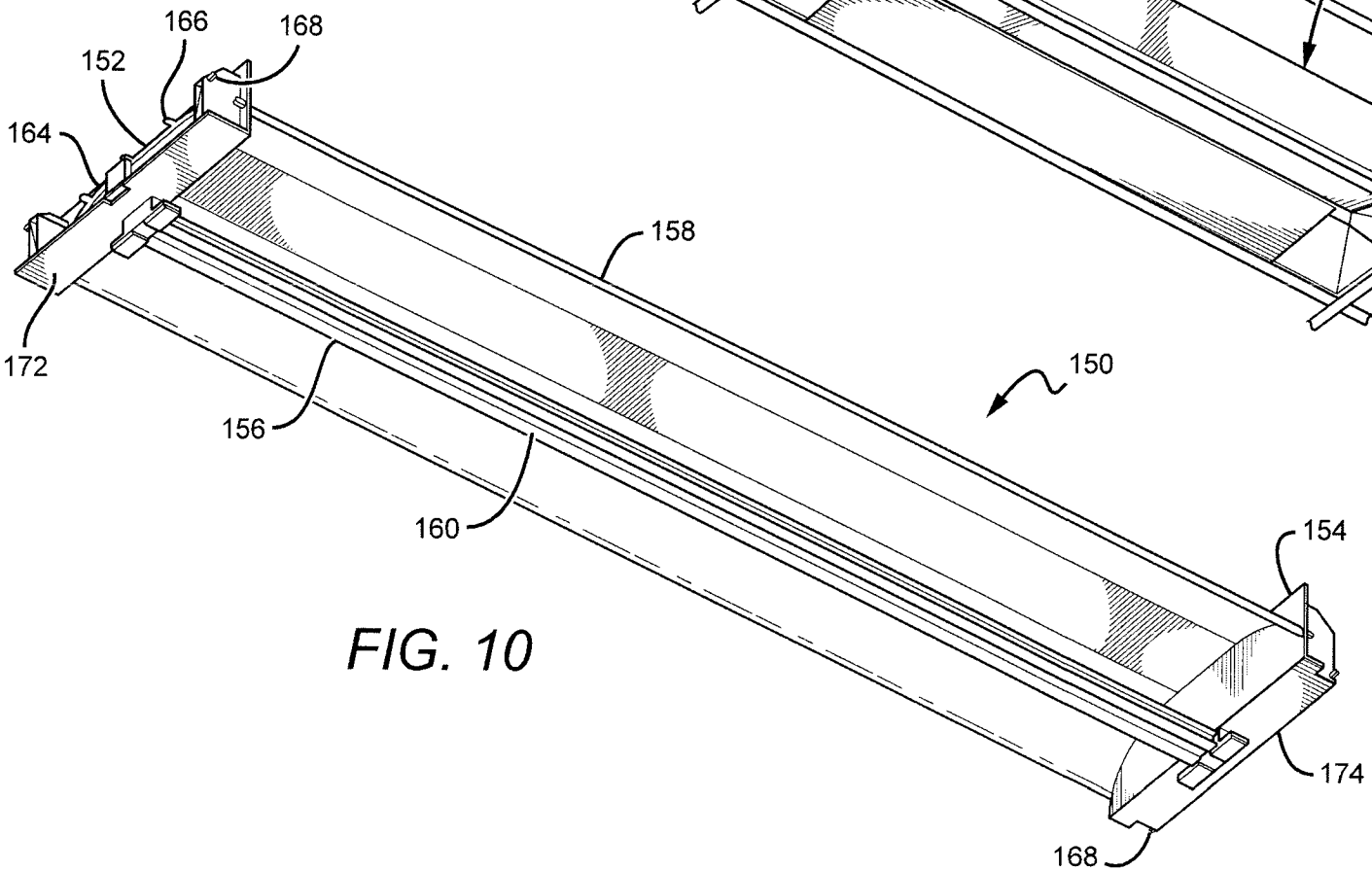
FIG. 10 is a bottom perspective view of another embodiment of a light engine according to an embodiment of the present invention.
Figure 11:
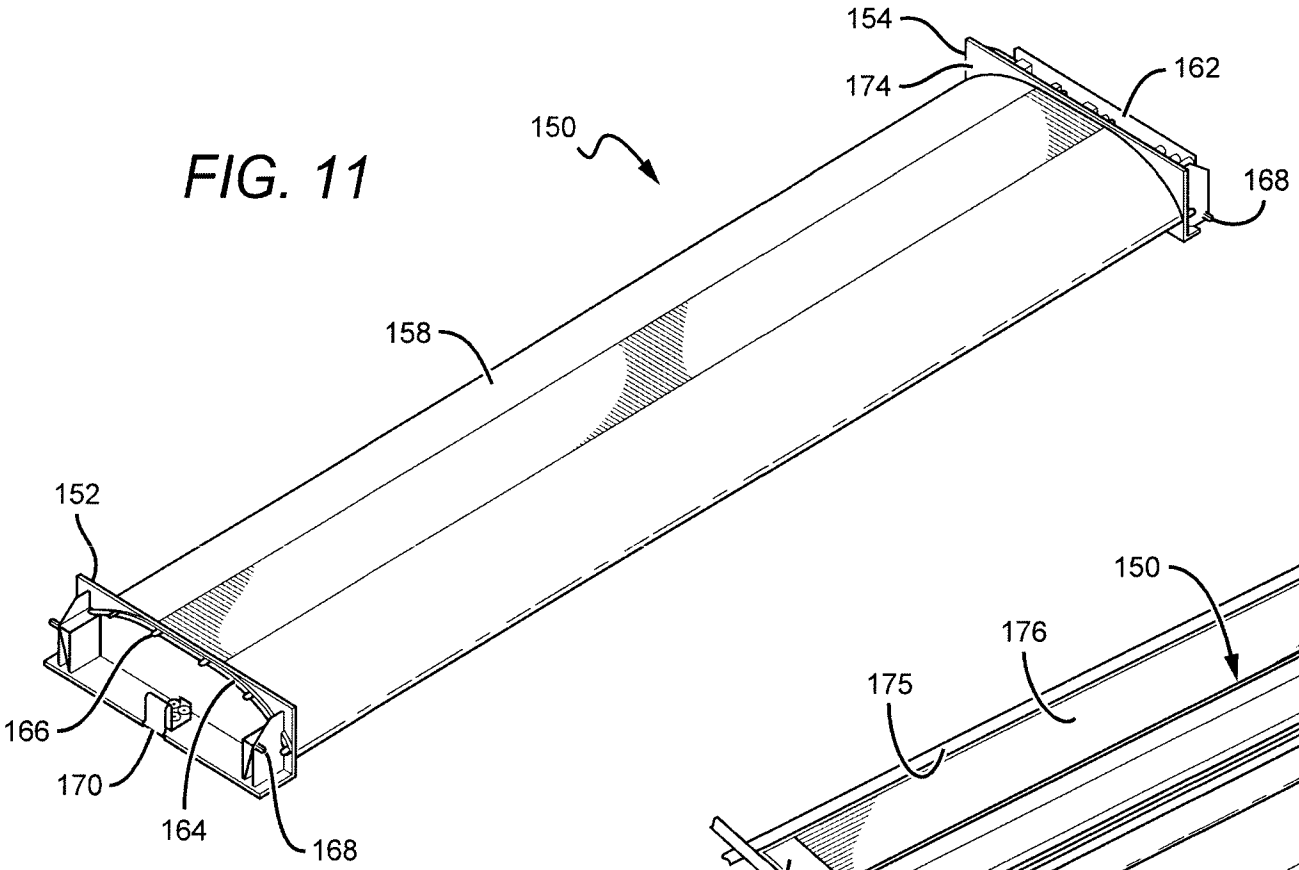
FIG. 11 is a top perspective view of the light engine in FIG. 10.

It is understood that embodiments presented herein are meant to be exemplary. The different features of the invention can be arranged in many different ways and the installation of the light engine can be accomplished using many different elements and steps. FIGS. 10 and 11 show another embodiment of a light engine 150 that can be used in retrofit systems according to the present invention. The light engine 150 comprises integral first and second mount adaptors 152, 154, each of which is one piece and is part of the light engine structure instead of a two piece structure added to the light engine as described above. The light engine 150 further comprises an elongated light source 156 and reflector 158, with the first and second mount adaptors 152, 154 mounted to respective ends of both.

The light source 156 can comprise many different types of emitters provided in many different patterns, with the embodiment shown comprising a linear array of light sources mounted on a heat sink 160 and emitting toward the reflector 158. The heat sink 160 can be made of many different heat conductive materials to conduct heat away from emitters to dissipate into the ambient, and can comprise heat dissipating features such as heat fins. In some embodiments, the light source 156 can comprise a linear array of light emitting diodes (LEDs), although it is understood that other light sources can also be used. Each of the LEDs can emit light with the same characteristics, such as emission intensity, color temperature, and color rendering index. This can result in the particular fixture emitting a substantially uniform emission, with the many industrial, commercial, and residential applications calling for fixtures emitting white light.

In some embodiments, a multicolor source is used to produce the desired light emission, such as white light, and several colored light combinations can be used to yield white light. For example, as discussed in U.S. Pat. Nos. 7,213,940 and 7,768,192, both of which are assigned to Cree, Inc., and both of which are incorporated herein by reference, it is known in the art to combine light from a blue LED with wavelength-converted yellow light to yield white light with correlated color temperature (CCT) in the range between 5000K to 7000K (often designated as "cool white"). Both blue and yellow light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The yellow light is emitted in a much broader spectral range and, thus, is called unsaturated light.

Another example of generating white light with a multicolor source comprises combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to van de Ven et al.

Other light sources can comprise series or clusters having two blue-shifted-yellow LEDs ("BSY") and a single red LED ("R"). BSY refers to a color created when blue LED light is wavelength-converted by a yellow phosphor. BSY and red light, when properly mixed, combine to yield light having a "warm white" appearance. These and other color combinations are described in detail in the previously incorporated patents to van de Ven (U.S. Pat. Nos. 7,213,940 and 7,768,192). The light sources according to the present invention can use a series of clusters having two BSY LEDs and two red LEDs that can yield a warm white output when sufficiently mixed.

The light sources can be arranged to emit relatively even emission with different luminous flux, with some embodiments having light sources that combine to emit at least 100 lumens, while other embodiments can emit at least 200 lumens. In still other embodiments the lighting sources can be arranged to emit at least 500 lumens.

The surfaces of reflector 158 facing the light source 156 can be reflective and can be arranged to reflect light from light source 156 to illuminate the space below the fixture 150. In some embodiments, the surfaces can comprise a diffuse or reflective coating to help reflect and disperse light from the LED light source 158. In some embodiments, surfaces of the reflector 158 can comprise a white diffusive material such as a microcellular polyethylene terephthalate (MCPET) material or a commercially available DuPont/WhiteOptics material, for example. Other white diffuse reflective materials can also be used. In other embodiments, the surfaces of the reflector 158 can be textured or can comprise a specular or semi-specular coating, layer or surface.

Diffuse reflective coatings and layers have the inherent capability to mix light from solid state light sources having different spectra (i.e., different colors). These coatings are particularly well-suited for multi-source designs where two different spectra are mixed to produce a desired output color point. A diffuse reflective coating can reduce or eliminate the need for additional spatial color-mixing; although, embodiments according to the present invention comprise lenses or diffusers used in combination with diffuse reflective coating. In some embodiments, the surfaces can also be coated with a phosphor material that can convert the wavelength of at least some of the light from the light emitting diodes to achieve a light output of the desired color point.

In other embodiments the surfaces of reflector 158 can comprise materials other than diffuse reflectors. For example, in some embodiments the surfaces can comprise a specular reflective material or a material that is partially diffuse reflective and partially specular reflective. In some embodiments, it may be desirable to use a specular material in one area and a diffuse material in another area. These are only some of the many combinations that are possible.

The light engine 150 can also comprise a circuit box 162 that can be located in different areas of the light engine 150. In the embodiment shown, the circuit box 162 can be located in the second mount adapter 154 and can house electronic components used to drive and control the light sources such as rectifiers, regulators, timing circuitry, and other elements. The circuit box 150 can be connected to electrical power in much the same way as the embodiment described above.

The first and second mount adaptors 152, 154 can comprise features or materials that allow for mounting to the reflector 158. These can include but are not limited to screws, bolts, snaps, brackets, and/or bonding materials. In the embodiment shown, each of the first and second mount adaptors 152, 154 have a curved mounting slot 164, with the edge of the reflector inserted in the slot 164 to hold the reflector 158 to the first and second mount adaptors 152, 154 at the desired curvature. The reflector 158 can also comprise tabs 166 that can be inserted through openings in the slot 164. In the case where the reflector 158 is made of a bendable material such as a metal, the tabs 164 can be bent over to hold the reflector 158 to the mount adaptors 152, 154. In other embodiments glues or other bonding agents can be used, while in still other embodiments the tabs 164 and openings can be sized to mate so that the tab snaps in the opening to hold the two together.

Figure 12:
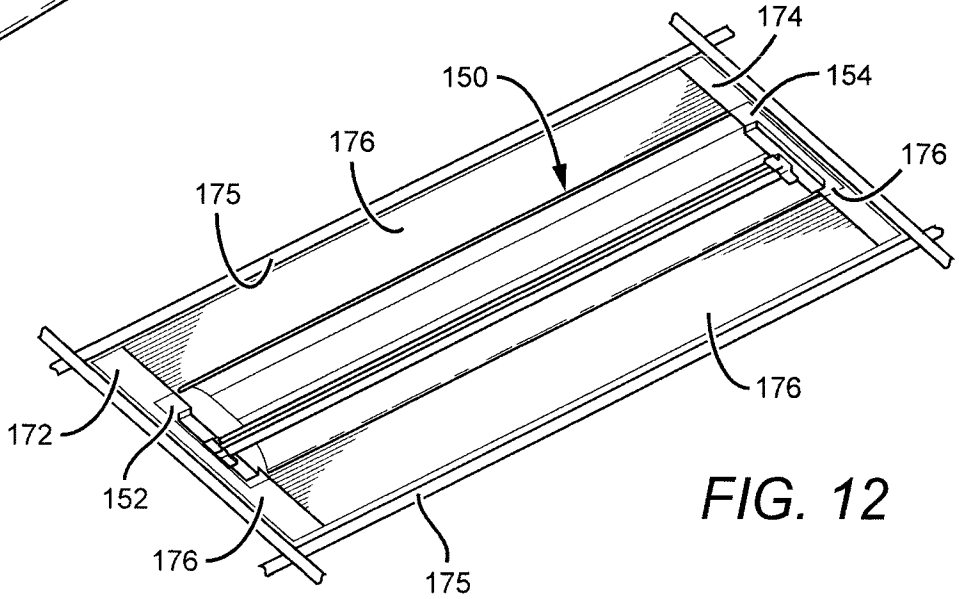
FIG. 12 is a bottom perspective view of the troffer pan opening with the light engine shown in FIG. 10 installed in the mounting frame.

The light engine 150 further comprises mechanisms to mount it in the end mounts and it is understood that many different mechanisms can be used such as the mechanisms described in the embodiment described above. Referring now to FIG. 12 in combination with FIGS. 10 and 11, the retrofit system for light engine 150 can comprise first and second end mounts 172, 174, that can be mounted in a ceiling T-grid 175 resting on the cross-members grid. Each of the first and second end mounts 172, 174 has adaptor openings 176 sized to accept one of the first and second adaptors 152, 154. Light engine 150 comprises a mounting pin 168 in the second mount adaptor 154, with the pins arranged to mate with a holes (not shown) in one the second end mount 174 end mounts. The pins can be compressible as described above, and when the pins 168 engage in the end mount 174, the light engine 150 can hang vertical from the end mount 174 from the mounting pin 168. This allows for the user to make "hands-free" wire connections to the circuit box 162, without having to hold the light engine 150.

The first mount adaptor 152 has a mounting tab 170 sized to fit in a mounting slot (not shown) in the first end mount 174. When the wiring to the circuit box 162 is complete, the light engine 150 can be rotated up about the mounting pin 168 to its mounted position, with the mounting tab 170 engaging the slot to hold the light engine in its mounted position as shown in FIG. 12.

The retrofit system for light engine 150 also comprises side panels 176 that are similar to side panels 96 described above. The side panels 176 can be mounted between the first and second end mounts 172, 174, along the longitudinal edge of the troffer pan opening. The side panels 176 can be mounted in the troffer pan opening 89 in many different ways. Like the embodiment above, the ends of each side panel 176 can comprise a side panel tab, and each of the end mounts 172, 174 can comprise two side panel slots (not shown). Each side panel tab is arranged to mate with one of the end mount slots as described above. When the side panels 176 are in place on the end mounts 172, 174, the mounting frame is complete. The side panels 176 hold the end mounts 172, 174 apart and in their proper location at opposing ends for the troffer pan opening. The entire retrofit system can be constructed without the need for adhesives or fastener such as brackets or screws. Like the components described above, the end mounts 80 and side panels 96 can be made of many different materials, with some embodiments being made of injection molded plastics.

It is understood that other embodiments can be installed in many different ways. By way of example, in other embodiments, the side panels can be installed after the light engine is installed in the end mounts. In this embodiment, the end mounts can be held in place at opposing ends of the troffer pan opening by friction until the light ending provides the final location restraint. In still other embodiments, the side panels can be integrated into the light engine rather than as separate parts.

The retrofit systems according to the present invention can also use many different light engines arranged in many different ways. In some embodiments the light engines can have mount adaptors that are removable and replaceable, which can provide flexibility in arranging the particular light engine for use with a particular mounting frame or features. In some alternative embodiments, light engines can be provided with other types integrated features that allow for directly mounting to the mounting frame (such as to the end mount) without the need for a mount adaptor. Light engines can also be provided with integral features that allow it to mount directly in the ceiling T-grid without the use of separate end mounts.

The retrofit system can also comprise alternative mechanisms for holding the lighting engine during wiring, such as tethers or other features to locate the lighting engine near the final position. Safety tethers or lanyards can also be provided for installation that would allow for hands free wiring connections to the light engine while preventing it from falling. Safety tethers and lanyards can also be included between the ceiling and the light engine to hold the light engine and prevent it from falling to the ground if the light engine was knocked from one or both of the end mounts, such as in an earthquake. Seismic brackets can also be included to hold the elements of the retrofit system in place in case of an earthquake.

The retrofit system can also be arranged in different ways to provide for different installation steps. The light engine can be arranged with alternative connection points such that it pivots about its longitudinal edge. The light engine can also be arranged so that it translates into its final position with or without being guided by mechanical links or other members, or follow any path that combines rotation and translation, rather than pivoting about a fixed axis.

In other alternative embodiments, the final wiring connections to the light engine can be made after the light engine is in its final position, with the connections being made through a port or door. The wiring can also be enclosed in a flame-rated conduit "whip" to provide a fire barrier for the wiring. This can allow for the use of non-flame rated materials.

It is understood that many different mounting frames can be used, some of which can comprise more or fewer pieces than those described above. Some alternative embodiments can comprise one, two or three piece arrangements. It is also understood that the present invention can be used in different sized troffer pans and ceiling T-grids, and can be used with different sized light engines. Application of similar mounting features can also allow for a light engine to be quickly and easily installed into a surface mount fixture.

Those skilled in the art will appreciate that many other variations may be made, such as the use of extruded aluminum for the retrofit system parts rather injection molded or sheet metal parts. In other embodiments, the plunger pin could be integrated as a molded feature in the end mount, mount adaptor or light engine. Other alternative arrangements include changing the feature that connects the light ending to the end mount such that it forms a hook, or locating plunger pins in the light engine rather than the end mount, or employing other attachment methods such as hook-and-loop fasteners, ¼ turn fastening features, magnets, and the like.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

We claim:

1. A system for mounting a light engine in a ceiling, comprising:

an elongated light engine with at least two mount adaptors and a circuit box, said light engine comprising an inner surface, first and second opposing sides, and first and second opposing ends, with each of said sides being longer than each of said ends, said circuit box attached to and at least partially covering said second end of said light engine;

wherein said at least two mount adapters are configured to fit on either of said first and second ends and configured such that said circuit box is connected between a portion of one of said mount adaptors and said second end of said elongated light engine, at least a portion of each of said at least two mount adaptors on said inner surface of said light engine; and end mounts configured for mounting in a ceiling opening, each of said end mounts comprising at least two mechanisms configured to mate with a respective one of said mount adaptors, at least one of said end mounts comprising a cavity sized to hold a respective one of said mount adaptors such that said mount adaptor is configured to at least partially fit within said cavity.

2. The system of claim 1, wherein said end mounts at least partially span said ceiling opening.

3. The system of claim 1, wherein said end mounts are configured to mate with said mount adaptors to hold said light engine in said ceiling opening.

4. The system of claim 1, wherein said ceiling opening comprises a T-grid ceiling opening.

5. The system of claim 4, wherein said end mounts rest on a lip of said T-grid opening.

6. The system of claim 1, further comprising side panels spanning between said end mounts.

7. The system of claim 6, wherein said side panels and said end mounts form a mount frame in said ceiling opening.

8. The system of claim 1, wherein said light engine comprises connection mechanisms to connect to a source of electrical power.

9. The system of claim 1, wherein one of said end mounts is capable of engaging with one of said mount adaptors to hold said light engine in an orientation vertical to said ceiling opening.

10. The system of claim 1, wherein said light engine comprises an elongated light source and a reflector.

11. The system of claim 10, wherein said light engine comprises white emitting light emitting diodes (LEDs).

12. A system for mounting a light engine in a T-grid ceiling opening, comprising:

a light emitting diode (LED) based light engine with at least two mount adaptors and a circuit box, said light engine comprising an inner surface, first and second opposing sides, and first and second opposing ends, with each of said sides being longer than each of said ends, said circuit box attached to and at least partially covering said second end of said LED based light engine;

wherein said at least two mount adapters are configured to fit on either of said first and second ends and configured such that said circuit box is connected between a portion of one of said mount adaptors and said second end of said elongated light engine, said one of said mount adaptors comprising distinct outer and inner mount adaptors, said circuit box between said outer and inner mount adaptors, at least a portion of said inner mount adaptor on said inner surface of said light engine; and end mounts configured for mounting in said T-grid ceiling opening, each of said end mounts comprising at least two mechanisms configured to mate with a respective one of said mount adaptors, at least one of said end mounts comprising a cavity sized to hold a respective one of said mount adaptors such that said mount adaptor is configured to at least partially fit within said cavity.

13. The system of claim 12, wherein a mount frame at least partially spans said ceiling opening.

14. The system of claim 12, wherein a mount frame is configured to mate with said mount adaptors to hold said light engine in said ceiling opening.

15. The system of claim 12, wherein a mount frame rests on a lip of said T-grid ceiling opening.

16. The system of claim 12, wherein a mount frame comprises side panels and said end mounts.

17. The system of claim 12, wherein said light engine is elongated.

18. The system of claim 12, wherein a mount frame is capable of mating with one of said mount adaptors to hold said light engine in an orientation vertical to said T-grid ceiling opening.

19. The system of claim 12, wherein said light engine comprises a linear array of LEDs and a reflector.

20. The system of claim 12, wherein said light engine LEDs emit white light.

21. A method for mounting a light engine in a ceiling opening, comprising:

providing a light engine comprising first and second opposing sides and first and second opposing ends, with each of said sides being longer than each of said ends, wherein a circuit box is attached to said second end of said light engine, and wherein a first outer mount adapter is attached to said first end of said light engine and a second outer mount adapter is attached to said second end of said light engine and said circuit box, wherein said circuit box physically contacts said second outer mount adapter;

configuring at least two inner mount adapters to mate with said outer mount adapters, wherein said inner mount adapters are distinct from said outer mount adapters, forming a first mount adapter over said first end and a second mount adapter over said second end;

mounting a mounting frame within said ceiling opening, said mounting frame comprising at least two mechanisms to engage with each of said mount adaptors;

engaging the first of said plurality of mount adaptors in said mounting frame;

connecting said light engine to a power source; and engaging the second of said mount adaptors in said mounting frame to hold said light engine in said ceiling opening, wherein said circuit box is connected between a portion of said second of said mount adaptors and said second end of said light engine.

22. The method of claim 21, further comprising hanging said light engine from said mount frame by said first mount adaptor during said connecting of said light engine.

23. The method of claim 21, wherein said ceiling opening comprises a T-grid ceiling opening.

24. The method of claim 23, wherein said mounting of said mounting frame within said ceiling opening comprises resting said mounting frame on a lip of said T-grid opening.

25. The method of claim 21, wherein said mounting frame comprises end mounts and side panels.

26. The method of claim 21, wherein said light engine is elongated.

27. The method of claim 21, wherein said light engine comprises white emitting light emitting diodes (LEDs).

28. A method for retrofitting a fluorescent light fixture in a T-grid ceiling opening above a room, comprising:

removing existing components of the fluorescent light fixture in said T-grid ceiling opening;

mounting first and second end mounts within and at least partially spanning said T-grid ceiling opening, said first and second end mounts being on opposing sides of said ceiling opening, each of said end mounts comprising at least two connection mechanisms, wherein each of said at least two connection mechanisms comprises a spring-action mechanism;

connecting a first outer mount adapter to said at least two connection mechanisms of said first end mount, and mating a first inner mount adapter with said first outer mount adapter, said first outer mount adapter distinct from said first inner mount adapter, said first outer mount adapter and said first inner mount adapter forming a first mount adapter over a first end of a light engine; and connecting a second outer mount adapter to said at least two connection mechanisms of said second end mount, and mating a second inner mount adapter with said second outer mount adapter, said second outer mount adapter and said second inner mount adapter forming a second mount adapter over a second end of said light engine, said end mounts holding said light engine in said T-grid ceiling opening, wherein said light engine comprises a circuit box attached to and at least partially covering said second end of said light engine, wherein said circuit box is connected between at least a portion of said second end mount and said second end of said light engine.

29. The method of claim 28, wherein a troffer pan of said existing fluorescent light fixture remains in said T-grid ceiling opening.

30. The method of claim 28, further comprising connecting said light engine to a power source.

31. The method of claim 28, further comprising hanging said light engine from one of said end mounts during said connecting of said light engine.

32. The method of claim 28, wherein said mounting of said end mounts within said T-grid ceiling opening comprises resting said end mounts on a lip of said T-grid opening.

33. The method of claim 28, further comprising side panels, said end mounts and said side panels forming a mount frame.

34. The method of claim 28, wherein said light engine is elongated.

35. The method of claim 28, wherein said light engine comprises white emitting light emitting diodes (LEDs).

36. The method of claim 28, wherein said first and second outer mount adapters are configured to face said room and wherein said first and second inner mount adapters are configured to face away from said room.

37. A system for mounting a light engine in a T-grid ceiling opening, comprising:

a light emitting diode (LED) based light engine comprising first and second opposing sides and first and second opposing ends, with each of said sides being longer than each of said ends, wherein a circuit box is attached to said second end of said LED based light engine;

a first outer mount adaptor;

a first inner mount adaptor distinct from said first outer mount adaptor, said first inner mount adapter configured to mate with said first outer mount adapter, forming a first mount adapter over said first end of said light engine;

a second outer mount adaptor;

a second inner mount adapter, said second inner mount adapter configured to mate with said second outer mount adapter, forming a second mount adapter over said second end of said light engine such that said circuit box is connected between a portion of said second mount adaptor and said second end of said light engine, said circuit box physically contacting said second outer mount adapter; and a mount frame mounted on and spanning across the T-grid ceiling opening, said mount frame comprising at least two mechanisms to mate with each of said mount adaptors to hold said light engine in said T-grid ceiling opening.

38. A system for mounting a light engine in a ceiling opening, comprising:

an elongated light engine, said light engine comprising first and second opposing sides, first and second opposing ends, and a circuit box, with each of said sides being longer than each of said ends, wherein said circuit box is attached to and at least partially covering said second end of said elongated light engine;

a first mount adaptor arranged on said first end of said light engine and configured for mating with a mounting frame or feature in said ceiling opening, a second mount adaptor arranged on said second end of said light engine and configured for mating with said mounting frame or feature in said ceiling opening, each of said first and second mount adaptors comprising an outer mount adaptor configured to fit on a respective one of said first and second ends of said elongated light engine such that said circuit box is connected between a portion of said second mount adaptor and said second end of said elongated light engine, each of said first and second mount adaptors further comprising an inner mount adapter configured to mate with said outer mount adapters;

wherein said mounting frame or feature in the ceiling opening comprises at least two mechanisms for mating with each of said mount adaptors, wherein said mounting frame or feature comprises at least one cavity each sized to hold one of said mount adaptors such that said mount adaptors are configured to at least partially fit within said respective at least one cavity.

39. The system of claim 38, wherein said inner and outer mount adaptors removably snap together and are anchored at a respective one of said first and second ends of said elongated light engine.

40. The system of claim 38, wherein said outer mount adaptor is configured for mounting to said mount frame or feature.

41. The system of claim 38, wherein said circuit box abuts said second end of said elongated light engine.

42. The system of claim 38, wherein said light engine further comprises a reflector, and wherein said circuit box abuts said reflector.

43. The system of claim 38, wherein said circuit box is connected between said outer mount adaptor of said second mount adaptor and said inner mount adaptor of said second mount adaptor.

44. The system of claim 43, wherein said light engine further comprises an inner surface, and wherein said inner mount adaptors are at least partially on said inner surface.

45. The system of claim 38, wherein said outer mount adaptors are configured to face below said ceiling opening, and wherein said inner mount adaptors are configured to face above said ceiling opening.

* * * * *